US010524043B2

(12) United States Patent
Kubo et al.

(10) Patent No.: US 10,524,043 B2
(45) Date of Patent: Dec. 31, 2019

(54) SPEAKER APPARATUS INCLUDING A PANEL AND VIBRATION ELEMENTS

(71) Applicant: DENSO TEN Limited, Kobe-shi, Hyogo (JP)

(72) Inventors: Masahiko Kubo, Kobe (JP); Keiichiro Tanaka, Kobe (JP)

(73) Assignee: DENSO TEN Limited, Kobe (JP)

( * ) Notice: Subject to any disclaimer, the term of this patent is extended or adjusted under 35 U.S.C. 154(b) by 0 days.

(21) Appl. No.: 15/868,430

(22) Filed: Jan. 11, 2018

(65) Prior Publication Data

US 2019/0020944 A1 Jan. 17, 2019

(30) Foreign Application Priority Data

Feb. 3, 2017 (JP) ..... 2017-018583

(51) Int. Cl.

| | |
|---|---|
| ***H04R 25/00*** | (2006.01) |
| ***H04R 1/28*** | (2006.01) |
| ***H04R 1/34*** | (2006.01) |
| ***H04R 9/06*** | (2006.01) |

(52) U.S. Cl.

CPC ..... *H04R 1/2811* (2013.01); *H04R 1/345* (2013.01); *H04R 9/063* (2013.01)

(58) Field of Classification Search

CPC ..... H04R 1/345; H04R 2217/03; H04R 9/063
USPC ..... 381/345
See application file for complete search history.

(56) References Cited

U.S. PATENT DOCUMENTS 4,352,961 A 10/1982 Kumada et al.
4,823,908 A * 4/1989 Tanaka ..... G10K 11/28 181/148
4,837,838 A 6/1989 Thigpen et al.
5,859,915 A * 1/1999 Norris ..... F41H 13/0081 381/75
5,901,235 A * 5/1999 Thigpen ..... H04R 13/00 381/399
6,151,398 A * 11/2000 Norris ..... G10K 9/13 367/140

(Continued)

FOREIGN PATENT DOCUMENTS

JP 2011-10224 A 1/2011
JP 2012-119842 A 6/2012

OTHER PUBLICATIONS

Mar. 22, 2019 Office Action issued in U.S. Appl. No. 15/875,243.

(Continued)

*Primary Examiner* — Phylesha Dabney
(74) *Attorney, Agent, or Firm* — Oliff PLC

(57) ABSTRACT

A speaker apparatus according to an embodiment includes a panel, one or more vibration elements, a drive unit, and a reflection part. The one or more vibration elements vibrate the panel. The drive unit applies a driving signal to the one or more vibration elements to form a striped vibration region on the panel. The driving signal is obtained by modulating a carrier wave of an ultrasonic band by a sound signal of an audible frequency band. The reflection part reflects at least one of first and second ultrasonic waves, which are generated from the vibration region and advancing in respective different directions, so as to bring an advancing direction of the first ultrasonic wave and that of the second ultrasonic wave close to each other.

3 Claims, 12 Drawing Sheets

(56) References Cited

U.S. PATENT DOCUMENTS

| | | | | |
|---|---|---|---|---|
| 6,229,899 | B1 * | 5/2001 | Norris | G10K 15/02 381/77 |
| 6,554,098 | B1 | 4/2003 | Komura | |
| 7,343,020 | B2 * | 3/2008 | Thigpen | H04R 5/02 381/302 |
| 8,155,344 | B2 | 4/2012 | Iimori et al. | |
| 9,398,358 | B2 | 7/2016 | Louh | |
| 2001/0055397 | A1 * | 12/2001 | Norris | G10H 1/0091 381/79 |
| 2003/0003879 | A1 | 1/2003 | Saiki et al. | |
| 2003/0059069 | A1 | 3/2003 | Bank et al. | |
| 2003/0118198 | A1 * | 6/2003 | Croft, III | G10H 1/0091 381/77 |
| 2003/0215103 | A1 * | 11/2003 | Norris | G10H 1/0091 381/77 |
| 2004/0109575 | A1 | 6/2004 | Thigpen | |
| 2007/0029899 | A1 * | 2/2007 | Matsuzawa | B06B 1/0292 310/334 |
| 2014/0293747 | A1 * | 10/2014 | Calvarese | G01S 7/52004 367/95 |
| 2018/0220229 | A1 * | 8/2018 | Tanaka | H04R 7/045 |
| 2019/0020944 | A1 * | 1/2019 | Kubo | H04R 9/063 |
| 2019/0124438 | A1 * | 4/2019 | Kubo | H04R 1/2811 |
| 2019/0124439 | A1 * | 4/2019 | Tanaka | B06B 1/06 |

OTHER PUBLICATIONS

U.S. Appl. No. 15/875,243, filed Jan. 19, 2018 in the name of Tanaka et al.
Sep. 18, 2019 Office Action issued in U.S. Appl. No. 15/875,243.

* cited by examiner

SPEAKER APPARATUS INCLUDING A PANEL AND VIBRATION ELEMENTS

CROSS-REFERENCE TO RELATED APPLICATION

This application is based upon and claims the benefit of priority of the prior Japanese Patent Application No. 2017-018583, filed on Feb. 3, 2017 the entire contents of which are incorporated herein by reference.

FIELD

The embodiments discussed herein are directed to a speaker apparatus.

BACKGROUND

Conventionally, there is known a speaker apparatus in which a plurality of ultrasonic vibrators is arranged in array to provide the directivity. This speaker apparatus is also called a parametric speaker, and applies, to the plurality of ultrasonic vibrators, the voltage of an ultrasonic wave modulated by a sound signal of an audible frequency band to be able to generate an audible sound in a specific direction (see Japanese Laid-open Patent Publication No. 2011-010224, for example).

However, the conventional speaker apparatus has a configuration in which a large number of ultrasonic vibrators are arranged in array in order to exert the directivity, and thus there exists a problem that miniaturization of a vibration part is difficult.

SUMMARY

According to an aspect of an embodiment, a speaker apparatus includes a panel, one or more vibration elements, a drive unit, and a reflection part. The drive unit applies a driving signal to the one or more vibration elements to form a striped vibration region on the panel. The driving signal is obtained by modulating a carrier wave of an ultrasonic band by a sound signal of an audible frequency band. The reflection part reflects at least one of first and second ultrasonic waves, which are generated from the vibration region and advancing in respective different directions, so as to bring an advancing direction of the first ultrasonic wave and that of the second ultrasonic wave close to each other.

BRIEF DESCRIPTION OF DRAWINGS

A more complete appreciation of the present disclosure and many of the attendant advantages thereof will be readily obtained as the same becomes better understood by reference to the following detailed description when considered in connection with the accompanying drawings, wherein.

DESCRIPTION OF EMBODIMENTS

Hereinafter, embodiments of a speaker apparatus, a speaker system, and a speaker-directivity adjusting method according to the present application will be described in detail with reference to the accompanying drawings. The present disclosure is not limited to the embodiments described in the following. For convenience of explanation, a three-dimensional orthogonal coordinate system including the Z-axis having the positive direction in the upward vertical direction is illustrated in a plurality of drawings including FIG. 1. In this orthogonal coordinate system, it is assumed that the positive direction of the Y-axis indicates the forward direction of the speaker apparatus, the positive direction of the X-axis indicates the leftward direction of the speaker apparatus, and the positive direction of the Z-axis indicates the upward direction of the speaker apparatus.

1. First Embodiment

1.1. Speaker Apparatus

Figure 1:
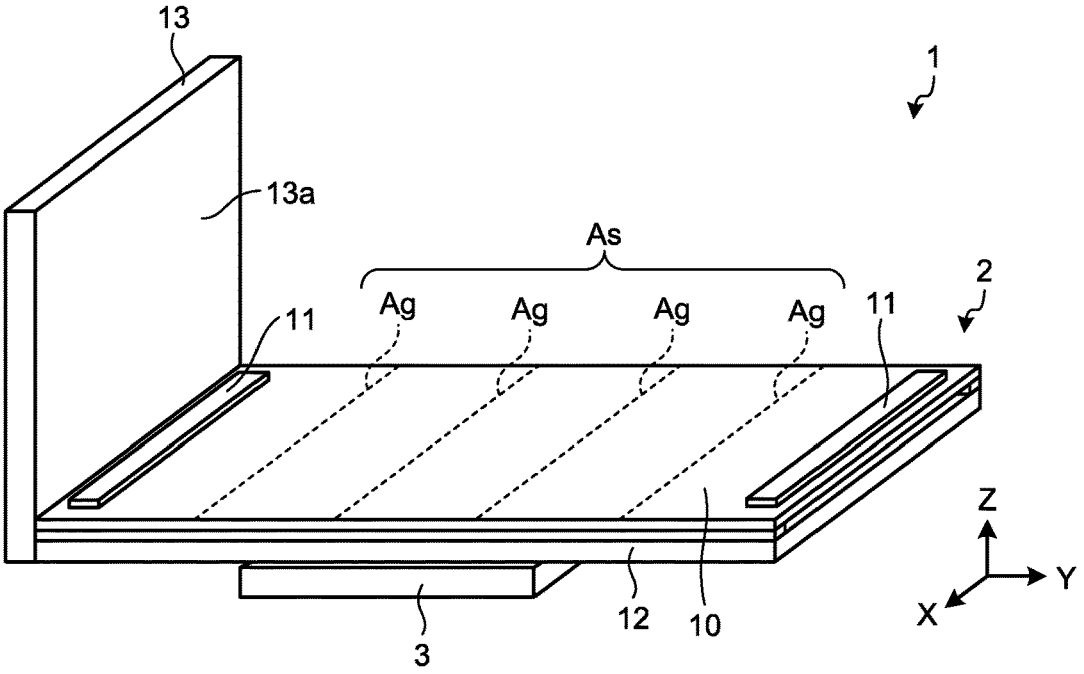
FIG. 1 is a schematic perspective view illustrating an approximate configuration of a speaker apparatus according to a first embodiment.

FIG. 1 is a schematic perspective view illustrating an approximate configuration of a speaker apparatus according to a first embodiment. As illustrated in FIG. 1, a speaker apparatus 1 according to the first embodiment includes a sound outputting unit 2 and a drive unit 3 that drives the sound outputting unit 2. The sound outputting unit 2 includes a panel 10, vibration elements 11 arranged on the panel 10, a support part 12 supporting the panel 10, and a reflection part 13 that reflects a part of ultrasonic waves generated from the panel 10.

The panel 10 is a plate-shaped member that is vibrated in response to vibration of the vibration elements 11, and is made of a rigid body such as glass. The panel 10 is fixed to the support part 12 via a fixing member to be supported by the support part 12. The vibration elements 11 include, for example, piezo elements, and are arranged on end parts of the panel 10. Each of the vibration elements 11 expands and contracts in accordance with a driving signal (for example, an alternating-current driving voltage signal) applied thereto so as to vibrate the panel 10.

The driving signal to be applied to the vibration elements 11 is generated by the drive unit 3. The drive unit 3 generates a driving signal including a frequency component of an ultrasonic band (frequency band equal to or more than 20 kHz) so as to generate a striped vibration region As on the panel 10. Specifically, the drive unit 3 amplifies a signal, which is obtained by modulating a carrier wave of the ultrasonic band, by a sound signal of an audible frequency band (less than 20 kHz) so as to generate a driving signal to be applied to the vibration elements 11.

The application of the driving signal to the vibration elements 11 causes the panel 10 to vibrate and a standing wave is generated so as to form the striped vibration region As on the panel 10. The striped vibration region As includes a plurality of line-shaped vibration regions Ag, and these line-shaped vibration regions Ag function as linear sound sources that radiate ultrasonic waves modulated by a sound signal.

In the example illustrated in FIG. 1, the vibration elements 11, each of which extends in a lateral direction (X-axis direction) of the panel 10, are arranged on respective both end parts in a longitudinal direction (Y-axis direction) of the panel 10. The vibration elements 11 vibrates to form a standing wave in the longitudinal direction of the panel 10, and the plurality of line-shaped vibration regions Ag, each of which extends in the lateral direction of the panel 10, is formed at equal intervals in the longitudinal direction of the panel 10.

This speaker apparatus 1 generates, in a specific direction, a sound wave according to a sound signal by (i) intensification and interference between ultrasonic waves generated from the plurality of line-shaped vibration regions Ag that are formed in the aforementioned manner and (ii) a natural demodulation phenomenon caused by non-linear distortion of the modulated ultrasonic waves. Thus, the speaker apparatus 1 functions as a speaker apparatus having the narrow directivity.

Figure 2:
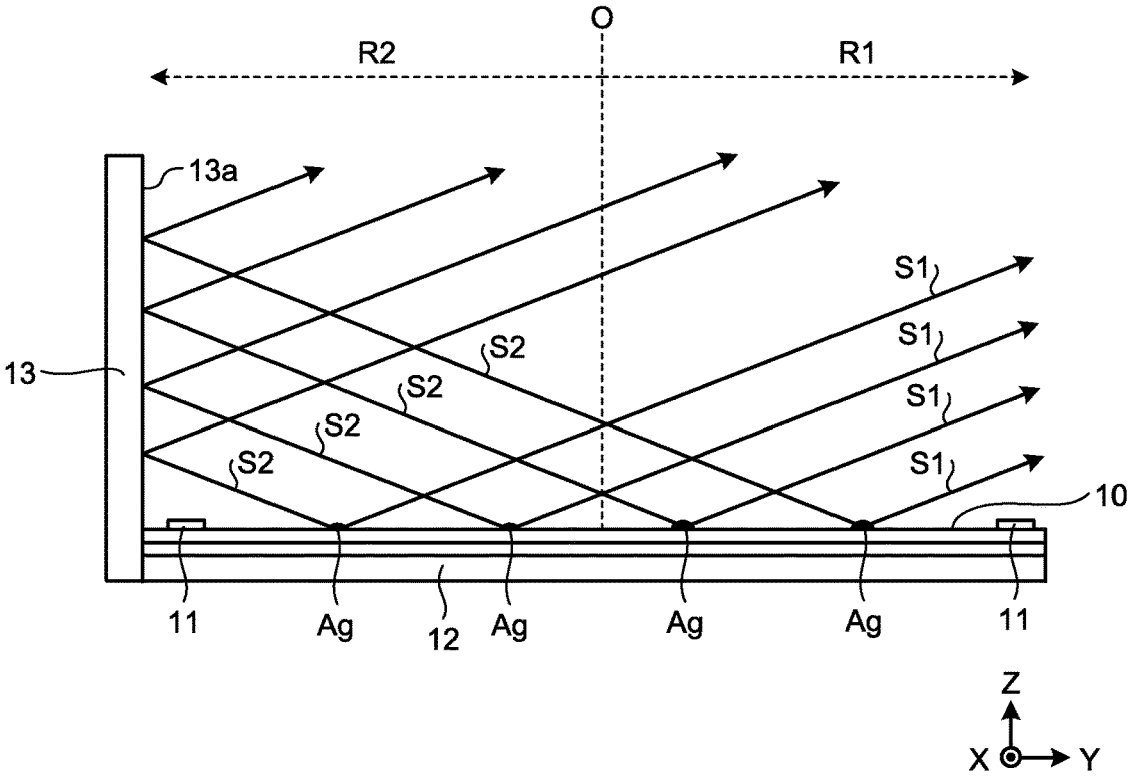
FIG. 2 is a diagram illustrating advancing directions of first and second ultrasonic waves generated from line-shaped vibration regions.

Meanwhile, to generate the directivity in a direction perpendicular to the panel 10 is difficult because of effects of phase interference between ultrasonic waves in space. From each of the line-shaped vibration regions Ag, in addition to a first ultrasonic wave S1 that advances in a first direction, a second ultrasonic wave S2 is output that advances in a second direction. The second direction is a direction that is symmetrical to the first direction with respect to an axis in the direction perpendicular to the panel 10 when seen along the lateral direction of the panel 10 (X-axis direction). FIG. 2 is a diagram illustrating advancing directions of the first ultrasonic waves S1 and the second ultrasonic waves S2 generated from the respective line-shaped vibration regions Ag.

As illustrated in FIG. 2, the first ultrasonic wave S1 and the second ultrasonic wave S2 advance symmetrically with respect to the direction perpendicular to the panel 10. Therefore, if it were not for the reflection part 13 illustrated in FIG. 2, the first ultrasonic waves S1 and the second ultrasonic waves S2 would advance in different directions with a center part O of the panel 10 in the longitudinal direction as the center. In other words, if it were not for the reflection part 13, the first ultrasonic waves S1 would be output, at predetermined angles, from the speaker apparatus 1 into a region R1 on one side in the longitudinal direction of the panel 10 and the second ultrasonic waves S2 would be output, at predetermined angles, from the speaker apparatus 1 into a region R2 on the other side in the longitudinal direction of the panel 10.

As described above, the speaker apparatus 1 according to the present embodiment includes the reflection part 13. Thus, the second ultrasonic wave S2, of the first and second ultrasonic waves S1 and S2 advancing in different directions from each of the line-shaped vibration regions Ag, is reflected from a reflection surface 13*a* of the reflection part 13, and the advancing direction of the first ultrasonic wave S1 and that of the second ultrasonic wave S2 are brought close to each other.

Thus, both of the first and second ultrasonic waves S1 and S2 are able to be output into the region R1 on one side in the longitudinal direction (Y-axis direction) of the panel 10, so that it is possible to configure a speaker apparatus having the directivity toward the region R1 without wasting the second ultrasonic waves S2.

In the example illustrated in FIG. 2, the reflection surface 13*a* of the reflection part 13 is arranged in a direction perpendicular to the panel 10. Thus, it is possible to output the first ultrasonic wave S1 and the second ultrasonic wave S2 in the same direction, however, the reflection surface 13*a* of the reflection part 13 may be arranged in a direction not perpendicular to the panel 10.

It is sufficient that the reflection part 13 may have a configuration in which at least one of the first and second ultrasonic waves S1 and S2 is reflected so that an advancing direction of the first ultrasonic wave S1 and that of the second ultrasonic wave S2 are brought close to each other. Hereinafter, the configuration of the speaker apparatus 1 according to the first embodiment will be explained more specifically.

1.2. Specific Configuration of Speaker Apparatus

Figure 3:
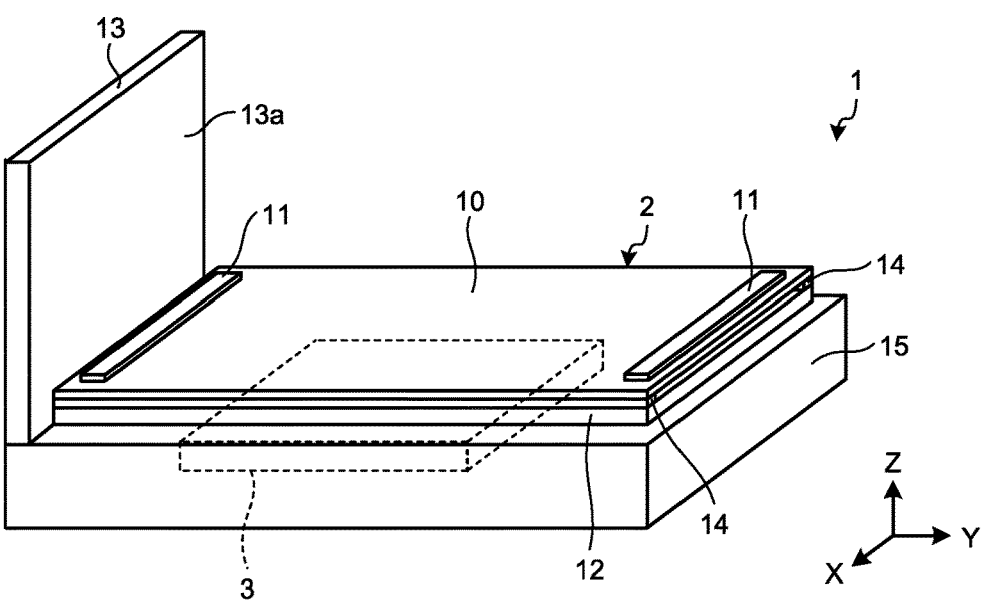
FIG. 3 is a schematic external view illustrating a configuration example of the speaker apparatus according to the first embodiment.

FIG. 3 is a schematic external view illustrating a configuration example of the speaker apparatus 1 according to the first embodiment. As illustrated in FIG. 3, the speaker apparatus 1 according to the first embodiment includes the sound outputting unit 2, the drive unit 3, and a housing 15. Hereinafter, the sound outputting unit 2, the housing 15, and the drive unit 3 will be specifically explained in this order.

1.2.1. Sound Outputting Unit

As described above, the speaker apparatus 1 includes the panel 10, the vibration elements 11, the support part 12, and the reflection part 13.

The panel 10 is a plate-shaped member having a rectangular shape and is vibrated in accordance with vibration of the vibration elements 11. The panel 10 is formed by a rigid body made of glass etc., not limited thereto, another member made of metal, plastic, or the like may be employed. The panel 10 may have another shape such as a square shape and a triangular shape, not limited to a rectangular shape. The support part 12 is formed by a rigid body made of glass etc., not limited thereto, another member made of metal, plastic, or the like may be employed.

The panel 10 is fixed to the support part 12 by fixing members 14. The fixing members 14 are made of, for example, thermoset resin that is cured by heat, not limited thereto, adhesion tapes, fixing tools (for example, screws) for fixing the panel 10 and the support part 12 therebetween, or the like may be appropriately employed. It is preferable that the fixing members 14 are members that are hardly deformed after the fixing in order to prevent the fixing members 14 from absorbing vibration of the vibration elements 11.

In the example illustrated in FIG. 3, both end parts of the panel 10 in the lateral direction (X-axis direction) are fixed to the support part 12 by the fixing members 14. In this manner, both end parts of the panel 10 in the lateral direction are fixed along the longitudinal direction of the panel 10 (Y-axis direction), and thus flexure of the panel 10 generated by vibration of the panel 10 is reduced. Thus, it is possible to suppress, in the panel 10, inhibition of generation of a standing wave or reduction in sound pressure. It is sufficient that fixed positions of the panel 10 and the support part 12 are for reducing flexure of the panel 10, and are not limited to both end parts of the panel 10 in the lateral direction.

Both ends of the panel 10 in the longitudinal direction are not fixed to the fixing members 14, and fixed to the support part 12 while placing a gap therebetween. Therefore, back pressure, which is the pressure generated on a reverse-face side (negative-direction side of Z-axis) of the panel 10, is able to be released from the above gap, and thus it is possible to reduce inhibition of vibration of the panel 10, which is caused by rebound of the back pressure from the panel 10. Another member other than the fixing members 14 may be employed to generate this gap, alternatively, a vibration controlling member for absorbing the back pressure may be arranged on or above the back surface of the panel 10.

As described above, the vibration elements 11 include piezo elements, it is sufficient that they are able to vibrate at a frequency corresponding to a driving signal Vo supplied from the drive unit 3, and thus may include vibration elements other than piezo elements. In the example illustrated in FIG. 3, the case is exemplified in which the number of the vibration elements 11 is two, however, the number of the vibration elements 11 one or equal to or more than three.

The reflection part 13 includes a reflection plate, and this reflection surface 13*a* of the reflection part 13 is arranged in a direction for intersecting the surface of the panel 10 so as to reflect a part of ultrasonic waves generated from the panel 10. This reflection part 13 will be mentioned later.

1.2.2. Housing

The housing 15 supports the support part 12 and the reflection part 13, and houses the drive unit 3 in its internal space. The housing 15 illustrated in FIG. 3 is formed into the shape of a box, the shape of the housing 15 is not limited to the example illustrated in FIG. 3.

1.2.3. Drive Unit

The drive unit 3 generates the driving signal Vo for causing the vibration elements 11 to vibrate, and applies the generated driving signal Vo to the vibration elements 11. The vibration elements 11 expands and contracts by the driving signal Vo supplied from the drive unit 3 to vibrate the panel 10, and generates on the panel 10 the striped vibration region As including the plurality of line-shaped vibration regions Ag.

Figure 4:
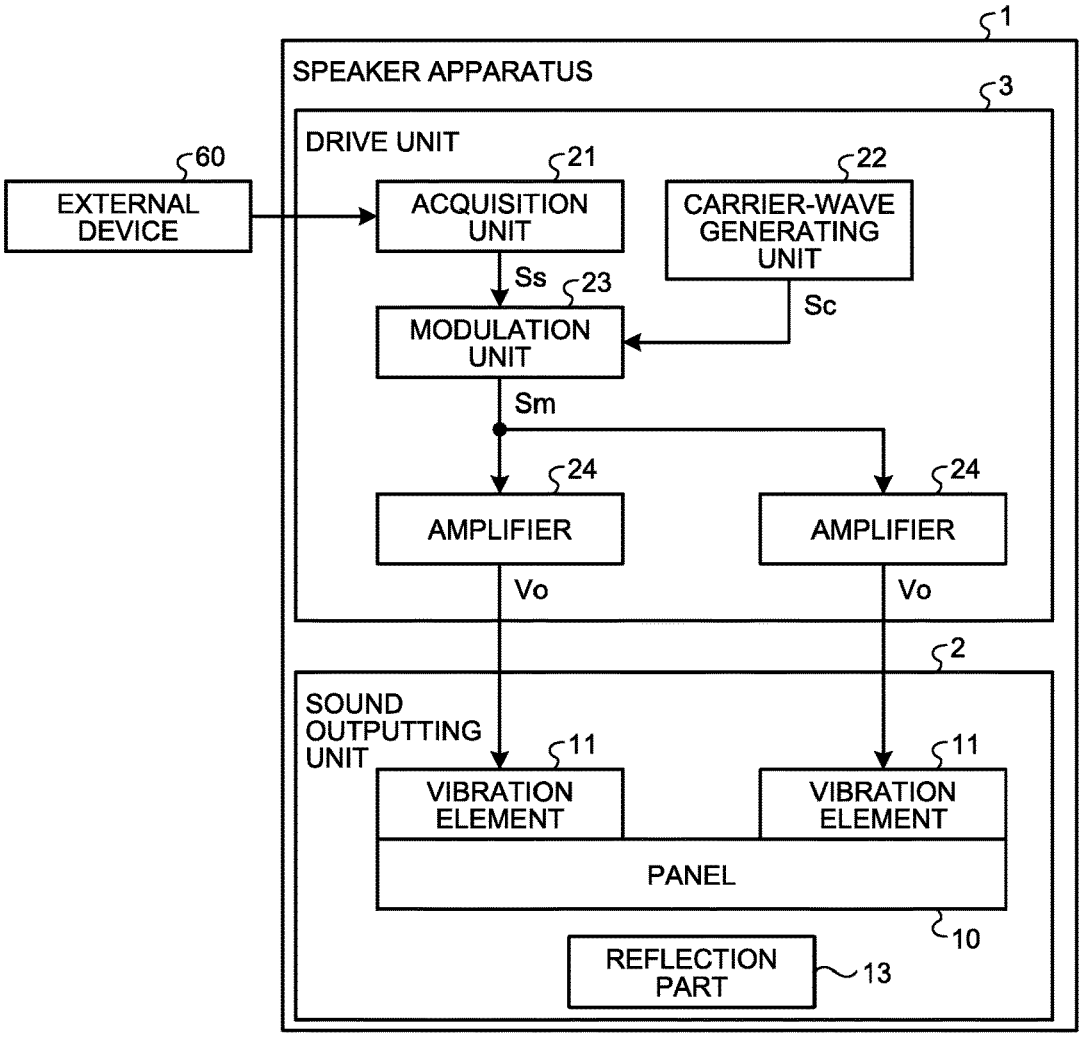
FIG. 4 is a block diagram illustrating the speaker apparatus according to the first embodiment.

FIG. 4 is a block diagram illustrating the speaker apparatus 1 according to the first embodiment. As illustrated in FIG. 4, the speaker apparatus 1 is connected with an external device 60, vibrates the panel 10 on the basis of a sound signal Ss input from the external device 60, and generates ultrasonic waves according to a carrier wave Sc modulated by the sound signal Ss.

The external device 60 is a device that outputs, to the speaker apparatus 1, the sound signal Ss of the audible frequency band (band less than 20 kHz), and is able to output the sound signal Ss to the outside, such as an audio device, a car navigation device, a smartphone, and a Personal Computer (PC).

The drive unit 3 includes an acquisition unit 21, a carrier-wave generating unit 22, a modulation unit 23, and amplifiers 24 so as to generate the driving signal Vo for causing the vibration elements 11 to vibrate, and applies the generated driving signal Vo to the vibration elements 11. The drive unit 3 includes (i) a computer, which includes, for example, a Central Processing Unit (CPU), a Read Only Memory (ROM), a Random Access Memory (RAM), a Hard Desk Drive (HDD), an input/output port, etc. and (ii) various circuits such as amplification circuits.

The CPU of the computer reads and executes various programs stored in the ROM, for example, and functions as the acquisition unit 21, the carrier-wave generating unit 22, and the modulation unit 23 of the drive unit 3. All or a part of the acquisition unit 21, the carrier-wave generating unit 22, and the modulation unit 23 of the drive unit 3 may be constituted of hardware such as an Application Specific Integrated Circuit (ASIC) and a Field Programmable Gate Array (FPGA). The amplifiers 24 are constituted of amplification circuits such as power amplifiers.

The acquisition unit 21 acquires the sound signal Ss output from the external device 60 and outputs the acquired sound signal Ss to the modulation unit 23. The acquisition unit 21 is also able to adjust the gain (amplitude) of the sound signal Ss and output the adjusted sound signal Ss to the modulation unit 23. The acquisition unit 21 may include a low-pass filter through which a signal of the audible frequency band passes, by employing this low-pass filter, it is possible to remove a signal of a band other than the audible frequency band.

The carrier-wave generating unit 22 generates the carrier wave Sc and outputs the generated carrier wave Sc to the modulation unit 23. The carrier wave Sc is a sine-wave signal of the ultrasonic band, causes the panel 10 to generate a standing wave, and has a frequency for forming the striped vibration region As.

The modulation unit 23 generates a modulation signal Sm, which is a signal obtained by modulating the carrier wave Sc input from the carrier-wave generating unit 22 by using the sound signal Ss input from the acquisition unit 21, and outputs the generated modulation signal Sm to the amplifiers 24. The modulation unit 23 performs the modulation by Amplitude-Modulation modulation (AM modulation) or Frequency-Modulation modulation (FM modulation). The AM modulation is Double Sideband modulation (DSB modulation) or Single Sideband modulation (SSB modulation), for example.

The modulation signal Sm output to the amplifiers 24 from the modulation unit 23 is amplified by each of the amplifiers 24, and is applied to the corresponding vibration element 11 as the driving signal Vo having an alternating-current voltage according to the waveform of the modulation signal Sm. The vibration elements 11 expand and contract in accordance with the applied driving signal Vo so as to cause the panel 10 to generate a standing wave. Antinodes of this standing wave become the line-shaped vibration regions Ag.

Figure 5:
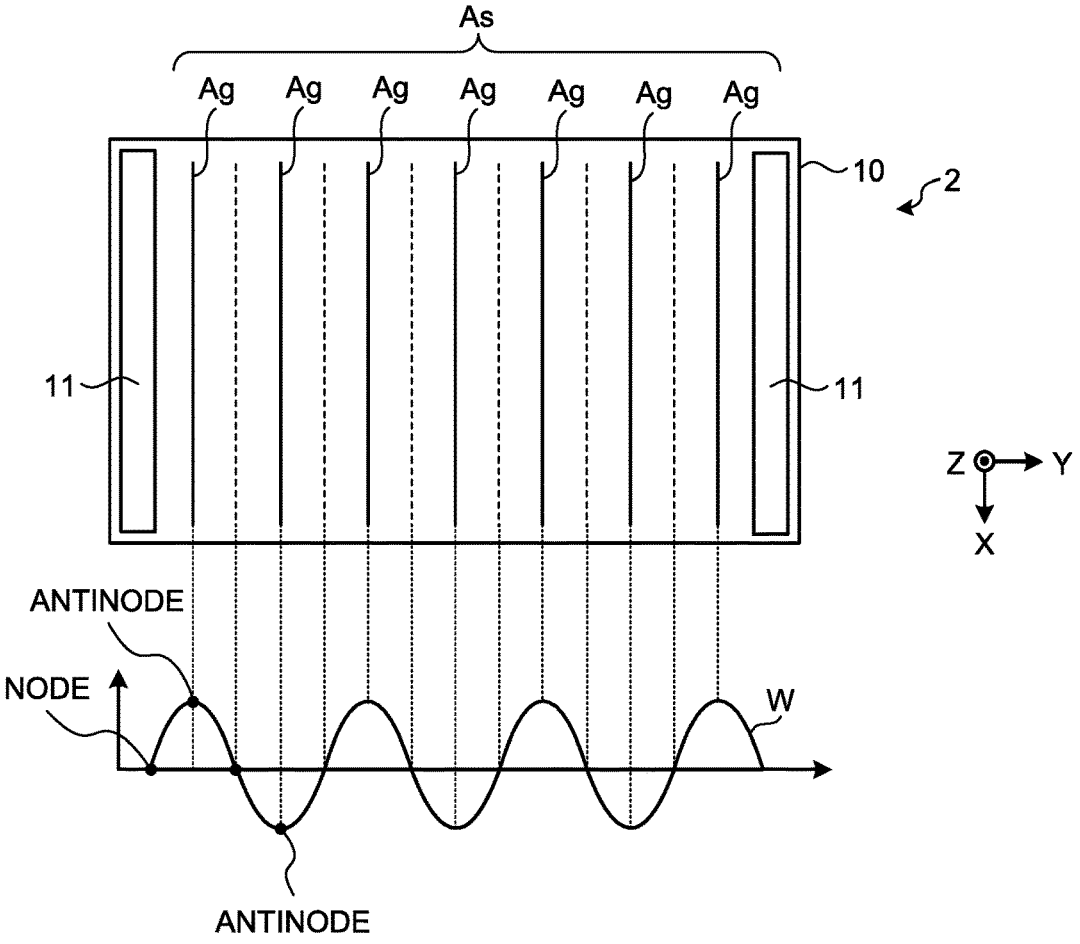
FIG. 5 is a diagram illustrating relation between the line-shaped vibration regions formed on a panel and a standing wave.

FIG. 5 is a diagram illustrating relation between the line-shaped vibration regions Ag formed on the panel 10 and a standing wave. In FIG. 5, antinodes of a standing wave W are indicated by using solid lines and nodes of the standing wave W are indicated by using dashed lines, and the antinode parts of the standing wave W function as the line-shaped vibration regions Ag. The antinode parts of the standing wave W are generated at equal intervals along the longitudinal direction of the panel 10, and thus the line-shaped vibration regions Ag are generated at equal intervals along the longitudinal direction (Y-axis direction) of the panel 10. In FIG. 5, for convenience of explanation, the example is illustrated in which the six line-shaped vibration regions Ag are generated by the standing wave W in the longitudinal direction of the panel 10, the number of the line-shaped vibration regions Ag is not limited to six, and is able to be larger as the frequency of the carrier wave Sc is higher.

Figure 6:
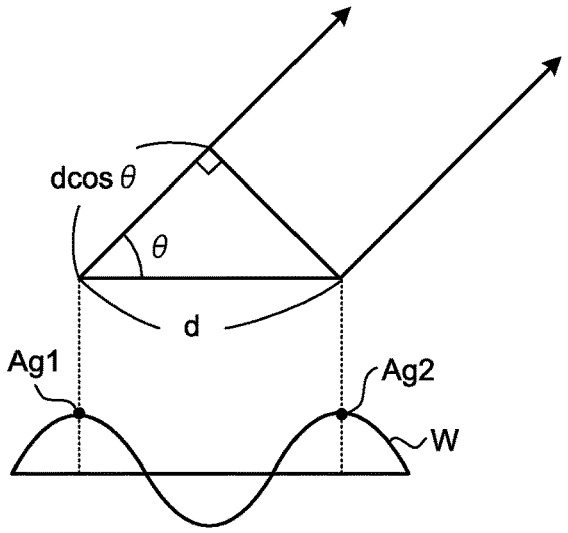
FIG. 6 is a diagram illustrating relation between the standing wave formed on the panel and the directivity of the speaker apparatus.

Next, the directivity of the speaker apparatus 1 will be explained. FIG. 6 is a diagram illustrating relation between the standing wave W formed on the panel 10 and the directivity of the speaker apparatus 1. In FIG. 6, for convenience of explanation, the standing wave W is partially illustrated. Adjacent antinodes of the standing wave W having the same phase are illustrated as line-shaped vibration regions Ag1, Ag2, and an angle θ is illustrated that is an angle, to the panel 10, of ultrasonic waves generated from the line-shaped vibration regions Ag1, Ag2.

The phase of one of the ultrasonic waves generated from the line-shaped vibration regions Ag1, Ag2 is shifted from the phase of the other by a distance (d×cos θ) with respect to the arbitrary angle θ. When a wavelength of the carrier wave Sc is "λ", the ultrasonic waves generated from the line-shaped vibration regions Ag1, Ag2 cancel each other at the angle θ where the distance (d×cos θ) is equal to odd number times of a wavelength λ/2. In other words, the ultrasonic waves are cancelled at the angle θ where the distance (d×cos θ) is equal to odd number times of the wavelength λ/2. On the other hand, the ultrasonic waves generated from the line-shaped vibration regions Ag1, Ag2 intensify each other at the angle θ where the distance (d×cos θ) is equal to integer number times of the wavelength A (namely, even number times of the wavelength λ/2). A sound wave of the audible frequency band is generated by a natural demodulation phenomenon caused by non-linear distortion of the ultrasonic waves when the ultrasonic waves propagate in the space or when the ultrasonic waves are reflected from a rigid body.

In this manner, the ultrasonic waves generated from the plurality of line-shaped vibration regions Ag phase-interfere (intensify and cancel) with each other to be able to advance the ultrasonic waves in a specific direction. A sound wave of the audible frequency band is generated by a natural demodulation phenomenon caused by non-linear distortion of the ultrasonic waves, and thus the speaker apparatus 1 is able to have a narrow directivity in a specific direction.

1.2.4. Reflection Part

Next, the reflection part 13 will be explained more specifically. The reflection part 13 includes a reflection plate and is formed by using material having high reflectance to sound. The reflection part 13 is formed by a plate member made of, for example, metal, glass, etc.

As described above, the speaker apparatus 1 has a narrow directivity in a specific direction, the angles θ (hereinafter, may be referred to as "angles θd") at which ultrasonic waves intensify each other symmetrically exist with respect to a line perpendicular to the panel 10.

Figure 7:
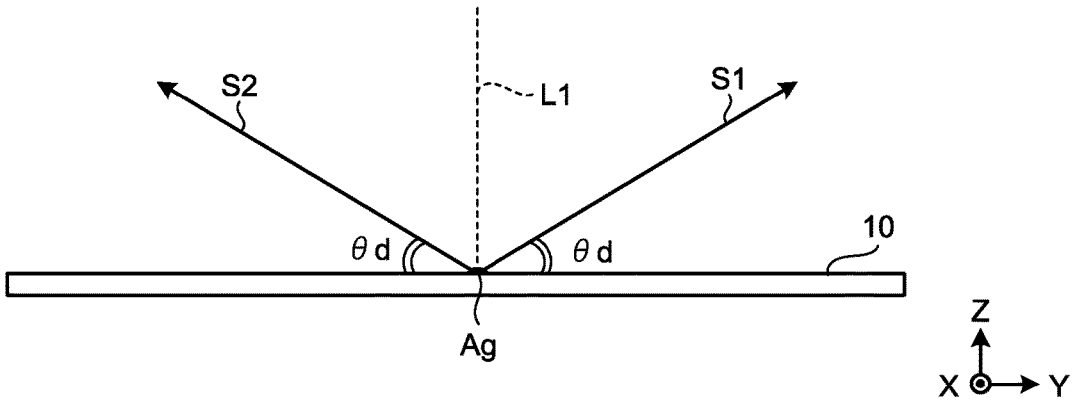
FIG. 7 is a diagram illustrating relation between an angle at which ultrasonic waves intensify each other and advancing directions of the ultrasonic waves.

FIG. 7 is a diagram illustrating relation between the angle θd at which ultrasonic waves intensify each other and advancing directions of the ultrasonic waves. As illustrated in FIG. 7, the first ultrasonic wave S1 and the second ultrasonic wave S2, which are generated at the angle θd from each of the line-shaped vibration regions Ag, advance in directions that are symmetrical with respect to a corresponding line L1 perpendicular to the panel 10.

Therefore, the speaker apparatus 1 is provided with the reflection part 13, this reflection part 13 brings an advancing direction of the first ultrasonic wave S1 and that of the second ultrasonic wave S2 close to each other, and utilize both of the first and second ultrasonic waves S1 and S2 so as to form a speaker apparatus having the directivity. The reflection part 13 includes a reflection plate and the reflection surface 13*a* of this reflection part 13 is formed by using material having high reflectance to sound. The reflection surface 13*a* is made of, for example, metal, glass, etc.

Figure 8:
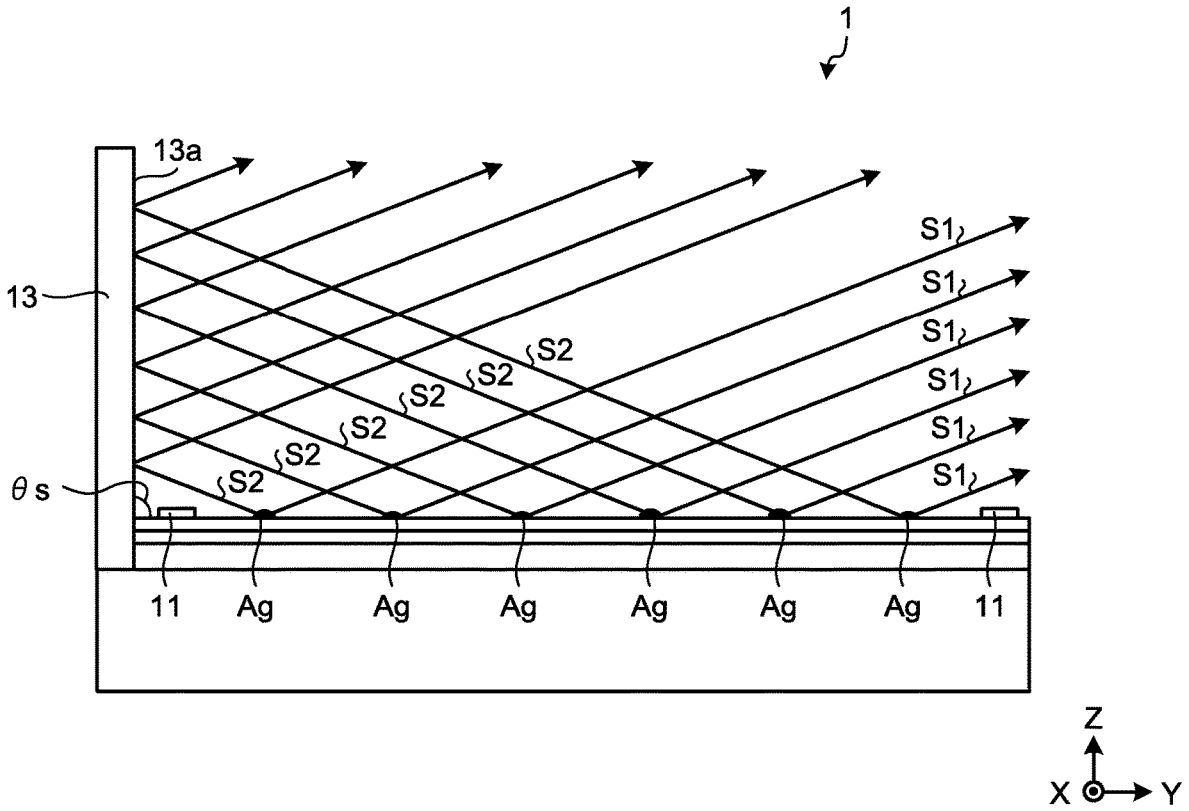
FIG. 8 is a diagram illustrating the advancing directions of the first and second ultrasonic waves generated from each of the line-shaped vibration regions.

FIG. 8 is a diagram illustrating the advancing directions of the first ultrasonic wave S1 and the second ultrasonic wave S2 generated from each of the line-shaped vibration regions Ag. The reflection part 13 illustrated in FIGS. 3 and 8 is arranged so that the reflection surface 13*a* is perpendicular to the surface of the panel 10. Thus, as illustrated in FIG. 8, an advancing direction of the second ultrasonic wave S2 is inverted by the reflection on the reflection surface 13*a* of the reflection part 13. Thus, the advancing direction of the second ultrasonic wave S2 and that of the first ultrasonic wave S1 become the same.

An angle θs (see FIG. 8) between the reflection surface 13*a* of the reflection part 13 and the surface of the panel 10 is not limited to an angle of 90°. In other words, it is sufficient that the angle is for performing reflection so as to bring an advancing direction of the first ultrasonic wave S1 and that of the second ultrasonic wave S2 close to each other. For example, when "θd=45°" is satisfied, let "45°<θs<135°" be satisfied, the first ultrasonic wave S1 and the second ultrasonic wave S2 are able to be output to an opposite side of the reflection part 13.

Figure 9:
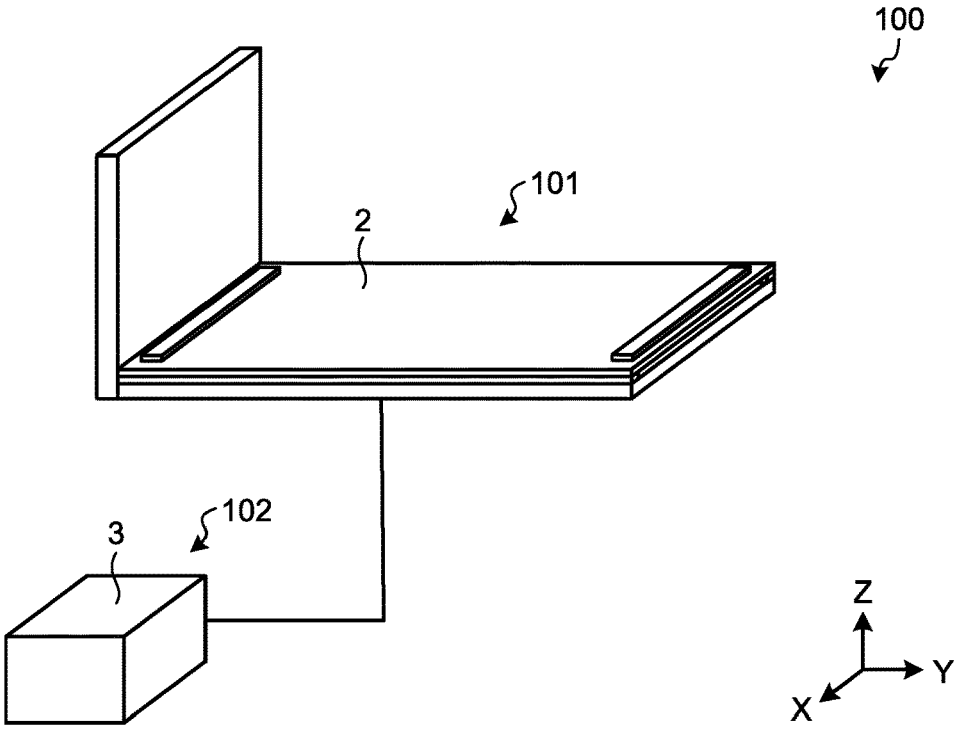
FIG. 9 is a diagram illustrating a configuration example of a speaker system according to the first embodiment.

In the above example, the speaker apparatus 1 including the sound outputting unit 2 and the drive unit 3 has been described, however, a speaker system may be employed in which the sound outputting unit 2 and the drive unit 3 are separately arranged. FIG. 9 is a diagram illustrating a configuration example of a speaker system 100 according to the first embodiment.

As illustrated in FIG. 9, the speaker system 100 includes (i) a speaker 101 including the sound outputting unit 2 and (ii) a driving apparatus 102 including the drive unit 3. The speaker 101 and the driving apparatus 102 are connected with each other in a wired or wireless manner, and ultrasonic waves are output from the speaker 101 by a driving signal output from the driving apparatus 102. When the speaker 101 and the driving apparatus 102 are connected with each other in a wireless manner, the speaker 101 and the driving apparatus 102 are provided with respective wireless communication units, and the speaker 101 is further provided with an amplifier for amplifying a signal output from the wireless communication unit to apply the amplified signal to the vibration elements 11.

Figure 10:
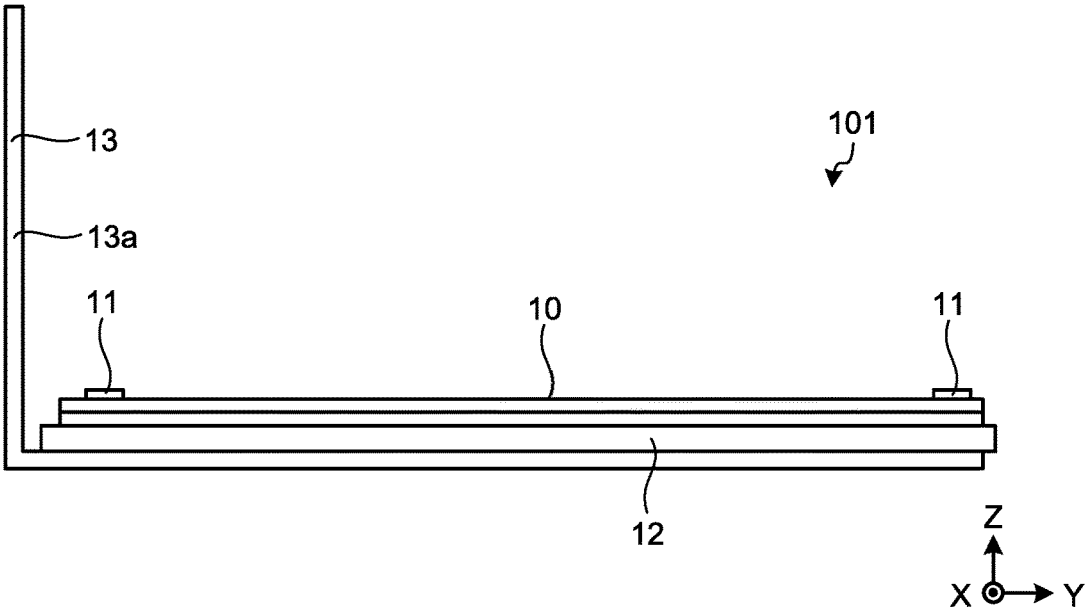
FIG. 10 is a schematic side view illustrating a speaker apparatus that is illustrated in FIG. 9.

FIG. 10 is a schematic side view illustrating the speaker 101 that is illustrated in FIG. 9. The speaker 101 illustrated in FIG. 10 uses an L-shaped reflection plate in a side view (when seen along X-axis direction) as the reflection part 13, the support part 12 is fixed on a region, in the reflection part 13, parallel to the panel 10 and the reflection surface 13*a* is formed on a region, in the reflection part 13, intersecting the panel 10.

Thus, it is possible to easily attach the reflection part 13 to a configuration body including the panel 10 and the support part 12. In a case of a speaker apparatus in which the sound outputting unit 2 and the drive unit 3 are integrally formed, an L-shaped reflection plate also may be used as the reflection part 13. In the present description, a configuration including the sound outputting unit 2 and the drive unit 3 may be referred to as a speaker apparatus, and the sound outputting unit 2 may be referred to as a speaker, however, a configuration including the sound outputting unit 2 and the drive unit 3 may be referred to as a speaker.

Figure 11:
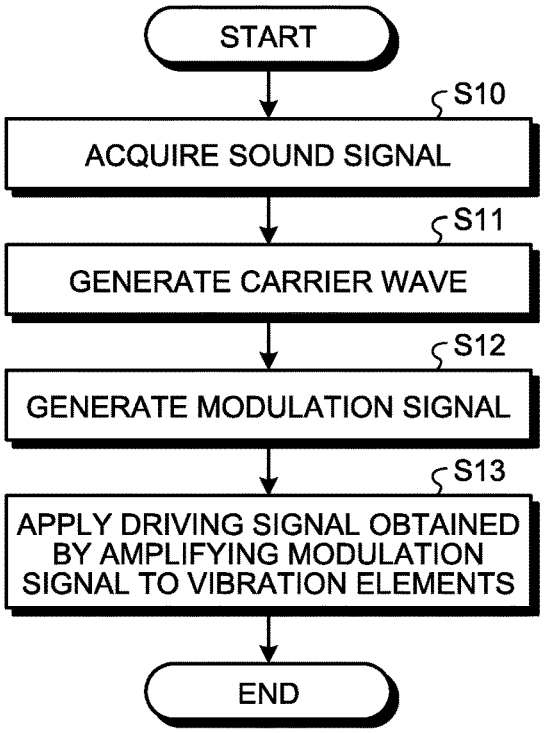
FIG. 11 is a flowchart illustrating one example of a processing procedure to be executed by a drive unit according to the first embodiment.

FIG. 11 is a flowchart illustrating one example of a processing procedure to be executed by the drive unit 3, and the procedure is repeatedly executed. As illustrated in FIG. 11, the drive unit 3 acquires the sound signal Ss from the external device 60 (Step S10). The drive unit 3 generates the carrier wave Sc (Step S11).

The drive unit 3 modulates the carrier wave Sc generated in Step S11 by using the sound signal Ss acquired in Step S10 so as to generate the modulation signal Sm (Step S12), and applies a driving signal obtained by amplifying the modulation signal Sm to the vibration elements 11 (Step S13). Thus, the striped vibration region As is formed on the panel 10. The reflection part 13 reflects at least one of the first and second ultrasonic waves S1 and S2, which are generated from the vibration region As and advancing in respective different directions, so as to bring an advancing direction of the first ultrasonic wave S1 and that of the second ultrasonic wave S2 close to each other.

As described above, the speaker apparatus 1 according to the first embodiment includes the panel 10, the one or more vibration elements 11 that vibrate the panel 10, the drive unit 3, and the reflection part 13. The drive unit 3 applies a driving signal to the one or more vibration elements 11 to form the striped vibration region As on the panel 10. The driving signal is obtained by modulating the carrier wave Sc of an ultrasonic band by the sound signal Ss of an audible frequency band. The reflection part 13 reflects at least one of first and second ultrasonic waves S1 and S2, which are generated from the striped vibration region As formed on the panel 10 and advancing in respective different directions, so as to bring an advancing direction of the first ultrasonic wave S1 and that of the second ultrasonic wave S2 close to each other. In this manner, the panel 10 and the one or more vibration elements 11 are able to constitute a vibration part having the directivity and the reflection part 13 changes the directivity, so that it is possible for the speaker apparatus 1 to change and adjust the directivity while miniaturizing the vibration part, compared with a configuration in which a plurality of ultrasonic vibrators is arranged in array. Moreover, it is possible to constitute a speaker apparatus having the directivity by utilizing both of the first and second ultrasonic waves S1 and S2.

The reflection part 13 is arranged close to an end part of the panel 10, and includes a reflection plate extending in a direction intersecting with the panel 10. Thus, the reflection part 13 is able to be easily formed. The length of the reflection part 13 in the up-and-down direction (Z-axis direction) is able to be shorter as the angle θ at which ultrasonic waves intensify each other is smaller, and thus it is possible to miniaturize whole of the speaker apparatus 1.

2. Second Embodiment

The reflection part 13 of the speaker apparatus 1 according to the first embodiment is constituted of a reflection plate arranged close to an end part of the panel 10, a reflection part of a speaker apparatus according to a second embodiment is different from the reflection plate according to the first embodiment in that the reflection part according to the second embodiment includes a plurality of reflection members arranged in positions opposite to an upper surface of the panel 10. Note that in the following, explanation of configuration elements having functions similar to those of the configuration elements according to the first embodiment is omitted by representing with the same reference symbols, and a part different from the speaker apparatus 1 according to the first embodiment will be mainly described.

Figure 12:
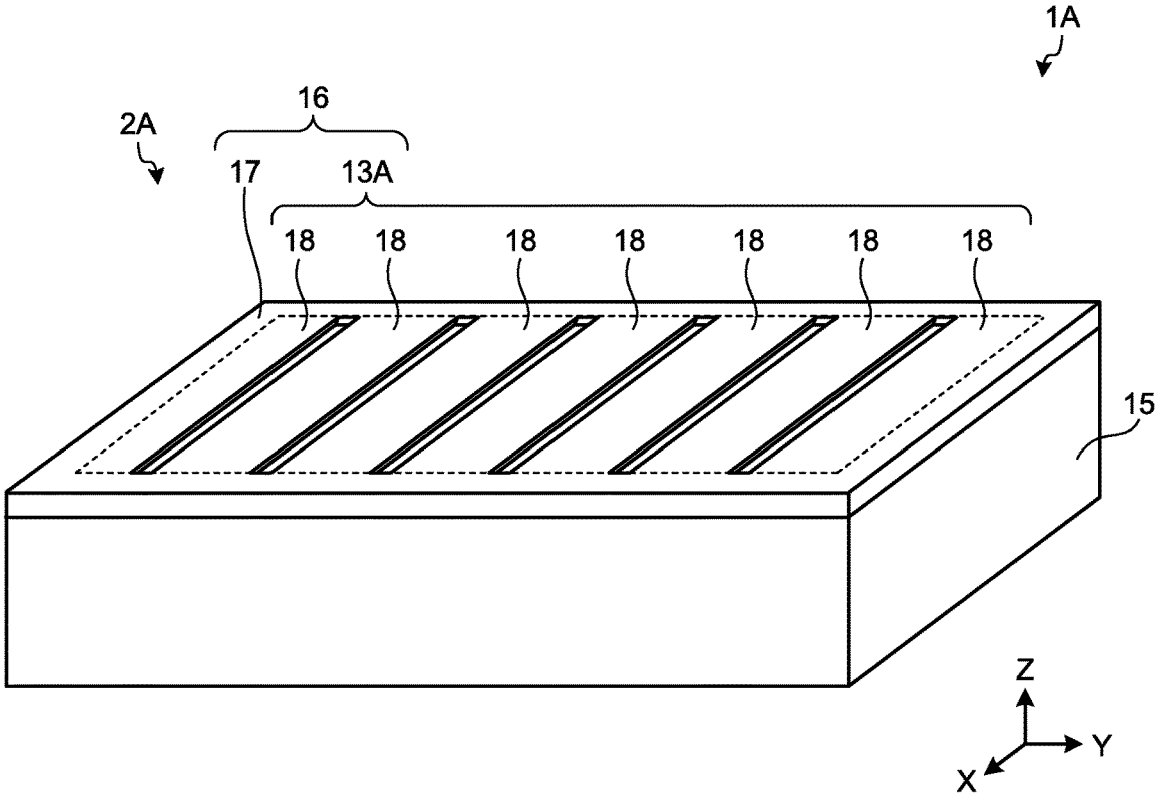
FIG. 12 is a schematic external view illustrating a configuration example of a speaker apparatus according to a second embodiment.

FIG. 12 is a schematic external view illustrating a configuration example of a speaker apparatus 1A according to the second embodiment. As illustrated in FIG. 12, the speaker apparatus 1A according to the second embodiment includes a sound outputting unit 2A, the drive unit 3 (not illustrated), and the housing 15. The housing 15 stores therein (i) the panel 10 that is supported by the support part 12 and on which the vibration elements 11 are arranged and (ii) the drive unit 3 (not illustrated).

The sound outputting unit 2A includes a cover member 16 instead of the reflection part 13 of the sound outputting unit 2. A reflection part 13A is formed in the cover member 16, and has a function as a reflection part for changing advancing directions of the ultrasonic waves, in addition to a function for covering the panel 10 that is supported by the support part 12 and on which the vibration elements 11 are arranged.

The cover member 16 includes a frame member 17, and the reflection part 13A is supported by the frame member 17. The reflection part 13A includes a plurality of reflection members 18 that are arrayed at predetermined intervals in the longitudinal direction of the panel 10 (Y-axis direction), each of the reflection members 18 extends in the lateral direction of the panel 10 (X-axis direction) and is supported by the frame member 17. Slits are formed between the reflection members 18, and thus it can be said that the cover member 16 is a slit-structure cover member.

Figure 13:
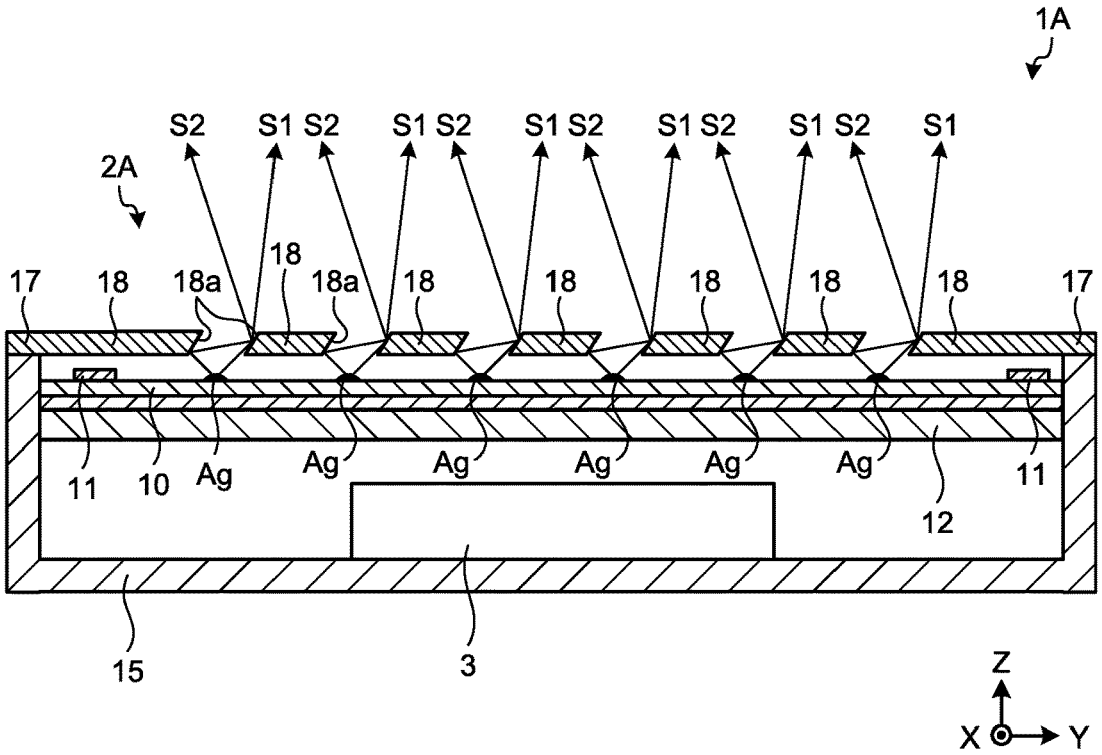
FIG. 13 is a longitudinal-cross-sectional view illustrating the speaker apparatus according to the second embodiment.

FIG. 13 is a longitudinal-cross-sectional view illustrating the speaker apparatus 1A according to the second embodiment. The sound outputting unit 2A of the speaker apparatus 1A illustrated in FIG. 13 is configured to include the panel 10, the vibration elements 11, the support part 12, and the cover member 16.

As illustrated in FIG. 13, the plurality of reflection members 18 formed in the cover member 16 are arranged to be opposed to the surface of the panel 10, and each of the reflection members 18 includes reflection surfaces 18*a* that reflects the first ultrasonic wave S1 and the second ultrasonic wave S2. These reflection surfaces 18*a* extend along an extending direction (X-axis direction) of the line-shaped vibration regions Ag and are formed on side surfaces of each of the reflection members 18.

The reflection surface 18*a* is made of material having high reflectance to sound, such as metal and glass. The reflection part 13A and the frame member 17 may be made of the same material, and are able to be integrally formed.

Figure 14:
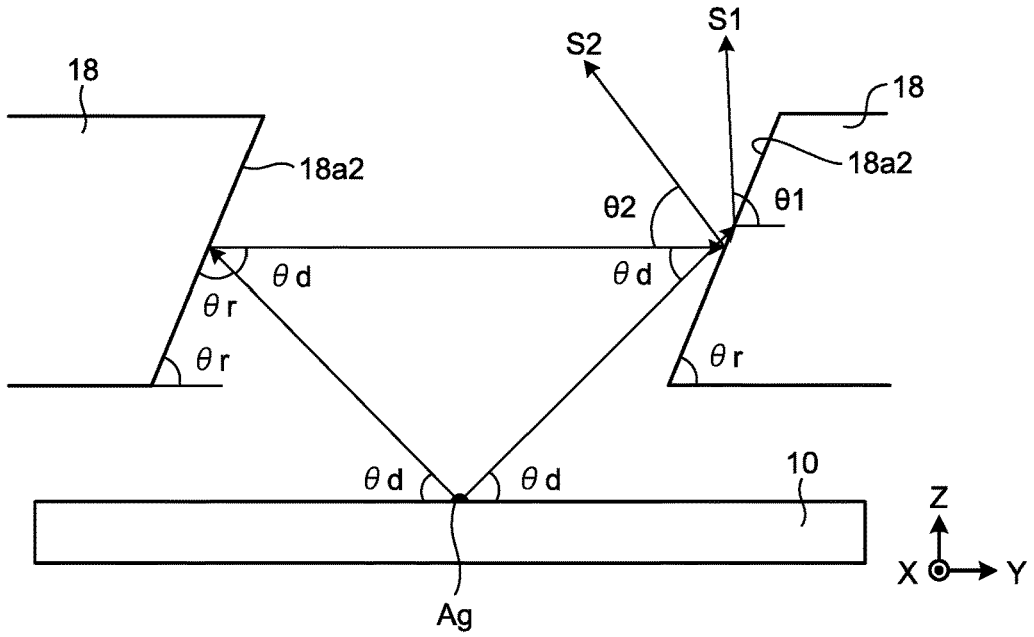
FIG. 14 is a diagram illustrating relation between reflection surfaces of reflection members and first and second ultrasonic waves according to the second embodiment.

FIG. 14 is a diagram illustrating relation between the reflection surfaces 18*a* of the reflection members 18 and the first and second ultrasonic waves S1 and S2. In FIG. 14, "θd" is an angle, of the plurality of line-shaped vibration regions Ag, at which ultrasonic waves intensify each other, and "θr" is an angle between each of the reflection surfaces 18*a* of the reflection member 18 and the surface of the panel 10. The angle θd and the angle θr of the speaker apparatus 1A according to the second embodiment are set to satisfy the following formula (1). In the following formula (1), "0<θd<60°" is satisfied.

$$2\theta d+\theta r=180 \quad (1)$$

The angles θd, θr are set so as to satisfy the above formula (1), an advancing direction corresponding to θ1 of the first ultrasonic wave S1 and an advancing direction corresponding to θ2 of the second ultrasonic wave S2, which are output from the speaker apparatus 1A, become angles indicated in the following formulae (2) and (3).

$$\theta 1=2\theta r-\theta d \quad (2)$$

$$\theta 2=180°-2\theta r \quad (3)$$

Thus, a difference Δθ between the advancing direction corresponding to θ1 of the first ultrasonic wave S1 and the advancing direction corresponding to θ2 of the second ultrasonic wave S2, which are output from the speaker apparatus 1A, is able to be smaller than a difference Δθo between an advancing direction of the first ultrasonic wave S1 and an advancing direction of the second ultrasonic wave S2, which are output from the panel 10. In other words, the reflection part 13A is able to reflect the first and second ultrasonic waves S1 and S2 so that the advancing direction corresponding to θ1 of the first ultrasonic wave S1 and the advancing direction corresponding to θ2 of the second ultrasonic wave S2 are close to each other. Note that "Δθ=|θ2−θ1|" and "Δθo=|180°−2θd|" are satisfied.

Figure 15:
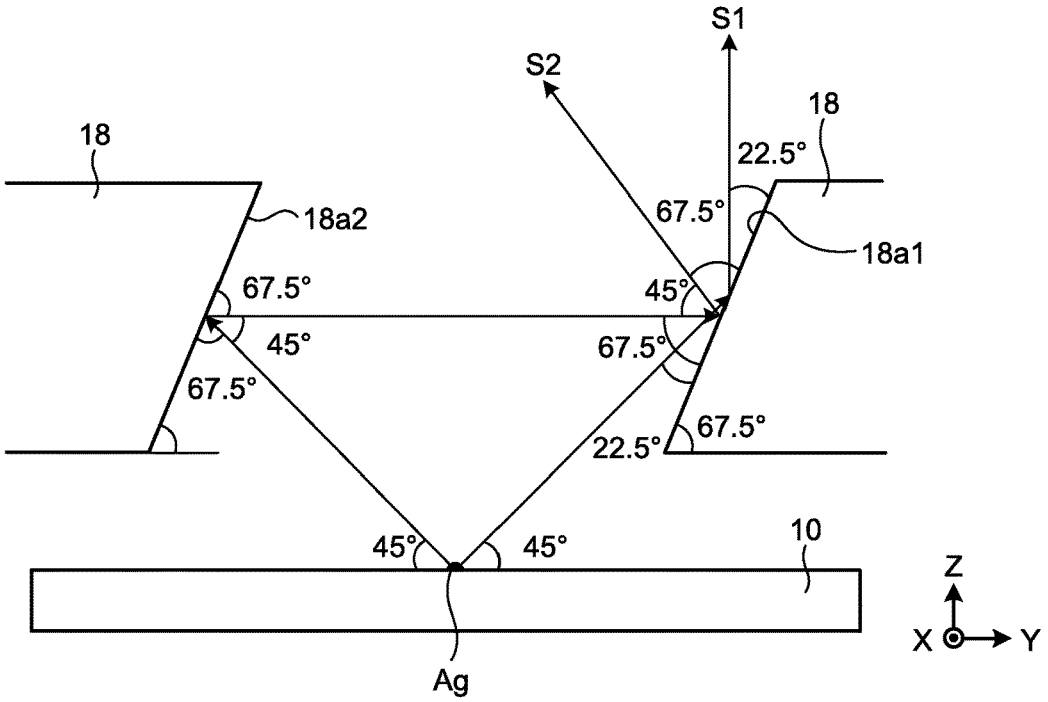
FIG. 15 is a diagram illustrating one example of advancing directions of the first and second ultrasonic waves according to the second embodiment.

FIG. 15 is a diagram illustrating one example of the advancing direction corresponding to θ1 of the first ultrasonic wave S1 and the advancing direction corresponding to θ2 of the second ultrasonic wave S2 when "θd=45°" and "θr=67.5°" are satisfied. In the examples illustrated in FIGS. 14 and 15, one of the opposing two reflection surfaces 18*a* of the reflection members 18 is a reflection surface 18*a*1, and the other is a reflection surface 18*a*2.

As illustrated in FIG. 15, the first ultrasonic wave S1 is made incident on the one reflection surface 18*a*1 at an angle of 22.5° to be reflected from the reflection surface 18*a*1. Thus, the first ultrasonic wave S1 is output from the speaker apparatus 1A at an angle of 90° to the surface of the panel 10, and "θ1=90°" is satisfied.

The second ultrasonic wave S2 is made incident on the other reflection surface 18*a*2 at an angle of 67.5° to be reflected from the reflection surface 18*a*2, next, advances at an angle of 67.5° to the one reflection surface 18*a*1 to be reflected from the reflection surface 18*a*1. Thus, the second ultrasonic wave S2 is output from the speaker apparatus 1A at an angle of 45° to the surface of the panel 10, and "82=45°" is satisfied.

Therefore, the first ultrasonic wave S1 and the second ultrasonic wave S2, whose advancing directions are different by an angle of 90° when they are output from the panel 10, are output from the speaker apparatus 1A in a state in which the advancing directions are different by an angle of 45°, caused by the plurality of reflection members 18.

The relation of θr to θd is not limited to the example indicated by the above formula (1), and it is sufficient that the relation of θr to θd satisfies "Δθ<Δθo". In other words, it is sufficient that the relation of θr to θd is set between the reflection members 18 so that an advancing direction of the first ultrasonic wave S1 and that of the second ultrasonic wave S2 are brought close to each other. In the examples illustrated in FIGS. 13 to 15, the reflection surfaces 18*a* of the reflection members 18 are formed to be flat-shaped, they may be formed to be arc-shaped in a longitudinal-cross-sectional view.

In the above examples, both of the first and second ultrasonic waves S1 and S2 are reflected from the reflection members 18. However, it is sufficient that the reflection members 18 reflect at least one of the first and second ultrasonic waves S1 and S2 so that an advancing direction of the first ultrasonic wave S1 and that of the second ultrasonic wave S2 are brought close to each other, and not limited to the above configurations.

As described above, the reflection part 13A of the speaker apparatus 1A according to the second embodiment is arranged in a position opposite to the surface of the panel 10, and includes the plurality of reflection members 18 that extends in an extending direction (X-axis direction illustrated in FIG. 13) of the plurality of line-shaped vibration regions Ag forming the striped vibration region As and are arrayed along an alignment direction (Y-axis direction illustrated in FIG. 13) of the plurality of line-shaped vibration regions Ag. In the speaker apparatus 1 according to the first embodiment, the larger is the angle θd, of each of the line-shaped vibration regions Ag, at which ultrasonic waves intensify each other, the longer is the length of the reflection part 13 in the up-and-down direction, in the speaker apparatus 1A according to the second embodiment, the reflection part 13A is formed in the cover member 16. Therefore, the speaker apparatus 1A according to the second embodiment is able to reduce the length thereof in the up-and-down direction regardless of the angle θd, so that it is possible to make the speaker apparatus 1A thinner while changing and adjusting the directivity.

The speaker apparatus 1A further includes the cover member 16 that covers an upper surface of the panel 10, and the plurality of reflection members 18 is formed in the cover member 16. In this manner, the cover member 16 is provided with a reflection function, and thus common parts are able to be used between the cover function and the reflection function, so that it is possible to make the speaker apparatus 1A thinner and reduce the cost.

3. Third Embodiment

The configuration of the cover member 16 of the speaker apparatus 1A according to the second embodiment has a cover function for covering the inner part of the speaker apparatus, in addition to a reflection function for controlling advancing directions of the sound waves. On the other hand, a cover member of a speaker apparatus according to a third embodiment is different from that according to the second embodiment in that the cover member according to the third embodiment has a heat radiating function for radiating heat generated from the vibration elements 11 etc., in addition to the reflection and cover functions. Note that in the following, explanation of configuration elements having functions similar to those of the configuration elements according to the second embodiment is omitted by representing with the same reference symbols, and a part different from the speaker apparatus 1A according to the second embodiment will be mainly described.

Figure 16:
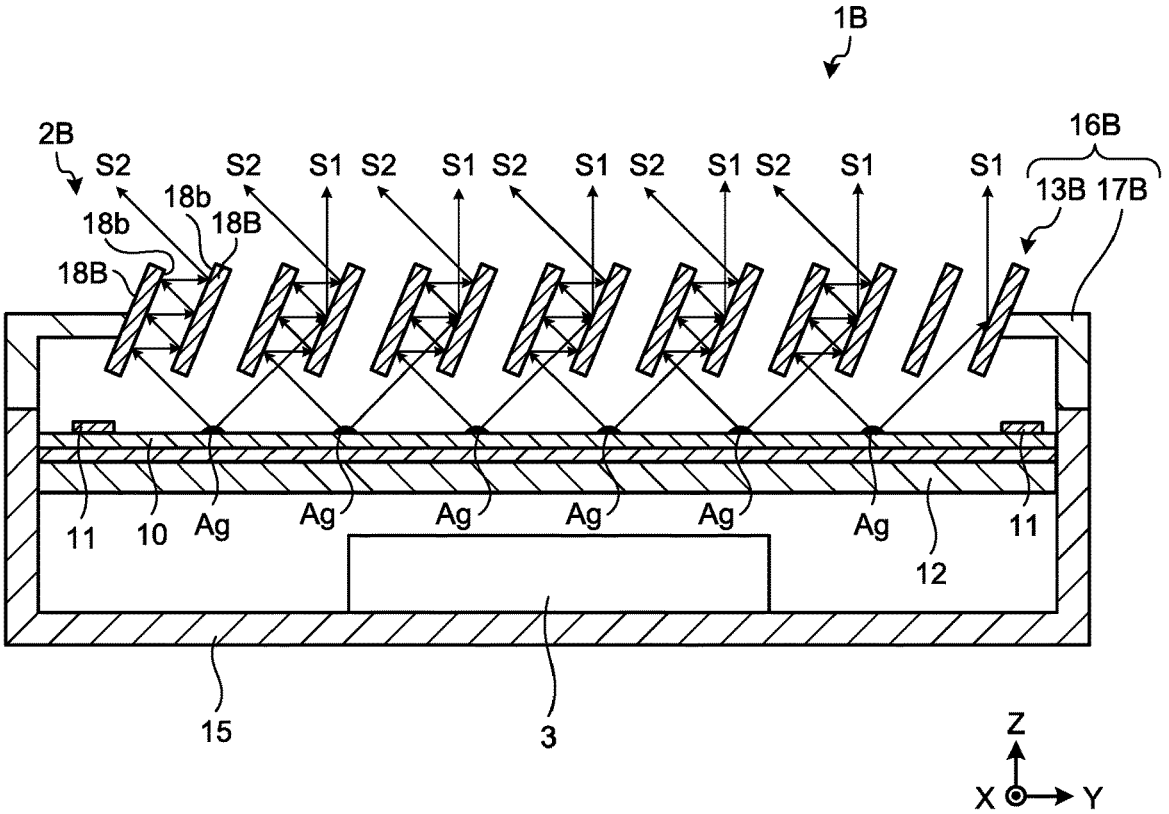
FIG. 16 is a longitudinal-cross-sectional view illustrating a speaker apparatus according to a third embodiment.

FIG. 16 is a longitudinal-cross-sectional view illustrating a speaker apparatus according to the third embodiment. A speaker apparatus 1B illustrated in FIG. 16 is different from the speaker apparatus 1A according to the second embodiment in that the speaker apparatus 1B includes a cover member 16B having a heatsink function instead of the cover member 16 illustrated in FIGS. 12 and 13, and the other part of the configuration is similar to that of the speaker apparatus 1A according to the second embodiment.

As illustrated in FIG. 16, a sound outputting unit 2B of the speaker apparatus 1B includes the panel 10, the vibration elements 11, the support part 12, and the cover member 16B. Reflection part 13B having a heat radiating function is formed in the cover member 16B. The cover member 16B includes a frame member 17B similar to the frame member 17, and the reflection part 13B is supported by the frame member 17B.

The reflection part 13B includes a plurality of reflection members 18B that is arrayed at predetermined intervals in the longitudinal direction of the speaker apparatus 1B. The plurality of reflection members 18B extends in an extending direction of the line-shaped vibration regions Ag, and is arrayed along an alignment direction of the plurality of line-shaped vibration regions Ag. Reflection surfaces 18*b* of these reflection members 18B are arranged at an angle similar to that of the reflection surfaces 18*a* of the reflection members 18. Thus, the reflection members 18B are able to reflect at least one of the first and second ultrasonic waves S1 and S2 by using the reflection part 13B so that an advancing direction of the first ultrasonic wave S1 and that of the second ultrasonic wave S2 are brought close to each other.

As described above, the reflection part 13B of the speaker apparatus 1B according to the third embodiment includes the plurality of reflection members 18B that is arranged in positions opposite to the surface of the panel 10, extends along the extending direction (X-axis direction illustrated in FIG. 16) of the plurality of line-shaped vibration regions Ag forming the striped vibration region As, and is arrayed along the alignment direction (Y-axis direction illustrated in FIG. 16) of the plurality of line-shaped vibration regions Ag. The plurality of reflection members 18B has a heat radiating function. Therefore, it is possible to make the speaker apparatus 1B thinner and more reduce the cost than a case where a heat radiating member is additionally provided.

4. Fourth Embodiment

A speaker apparatus according to a fourth embodiment is different from the speaker apparatuses 1, 1A, 1B according to the first to third embodiments in that the speaker apparatus according to the fourth embodiment has a function for switching between a narrow directivity and a wide directivity. The speaker apparatus according to the fourth embodiment includes any one of the reflection parts 13, 13A, 13B, in the following, it is assumed that the speaker apparatus according to the fourth embodiment includes the reflection part 13A. Note that in the following, explanation of configuration elements having functions similar to those of the configuration elements according to the first to third embodiments is omitted by representing with the same reference symbols, and a part different from the speaker apparatus 1A according to the second embodiment will be mainly described.

Figure 17:
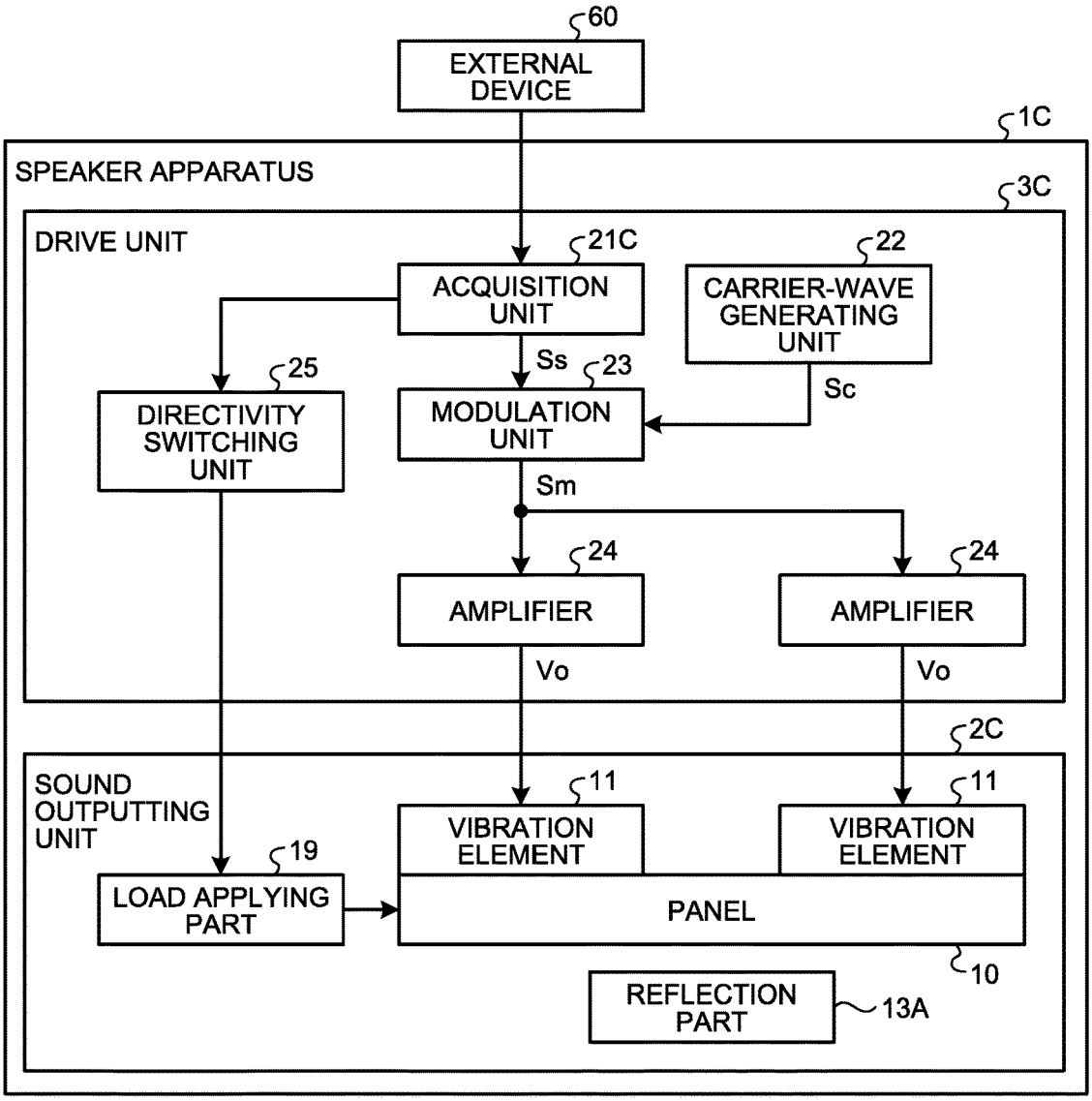
FIG. 17 is a block diagram illustrating a speaker apparatus according to a fourth embodiment.

FIG. 17 is a block diagram illustrating a speaker apparatus according to the fourth embodiment. As illustrated in FIG. 17, a speaker apparatus 1C according to the fourth embodiment includes a sound outputting unit 2C and a drive unit 3C.

The sound outputting unit 2C includes, similarly to the sound outputting unit 2A, the panel 10, the plurality of vibration elements 11, the support part 12 (not illustrated), and the reflection part 13A, and further includes a load applying part 19. The load applying part 19 applies a load to the panel 10 so as to suppress generation of the standing wave W (see FIG. 6) in the panel 10.

In the speaker apparatus 1C, similarly to the speaker apparatuses 1, 1A, 1B, ultrasonic waves are output from the panel 10 by the standing wave W generated in the panel 10. These ultrasonic waves include, for example, a first ultrasonic wave having a reference frequency and a second ultrasonic wave having a frequency shifted from the reference frequency, when the sound pressure is high (for example, 100 sBSPL), a frequency difference between the first and second ultrasonic waves is output as a sound wave (hereinafter, may be referred to as "difference tone") of the audible frequency band by non-linearity of air propagation. This non-linearity is caused by reflection, from a rigid body, of an ultrasonic wave or collision between molecules in the air.

The load applying part 19 of the speaker apparatus 1C applies a load to the panel 10 and suppresses generation of the standing wave W in the panel 10 so as to forcibly generate the non-linearity in the panel 10, and generates a difference tone between first and second ultrasonic waves on the surface of the panel 10. Any standing wave is not generated on the panel 10, and thus radiation of an ultrasonic wave from the panel 10 is suppressed. On the other hand, a difference tone between the first and second ultrasonic waves is formed on the surface of the panel 10, so that it is possible to output a sound wave having a wide directivity of the audible frequency band.

Figure 18:
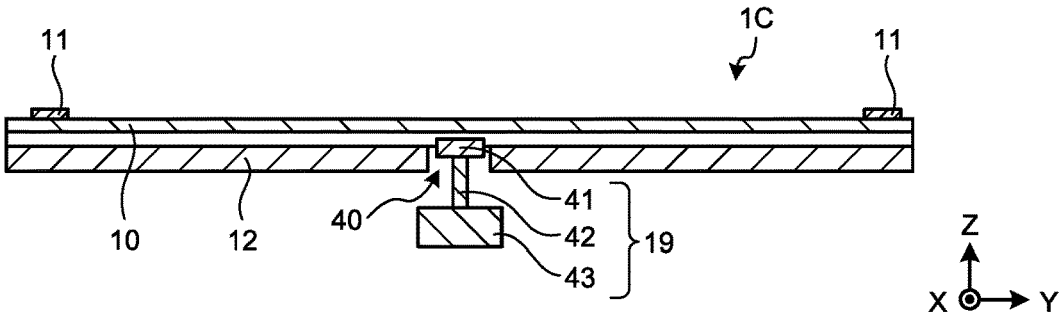
FIG. 18 is a schematic cross-sectional view illustrating one example of a speaker apparatus according to the fourth embodiment.

FIG. 18 is a schematic cross-sectional view illustrating one example of the speaker apparatus 1C. In the example illustrated in FIG. 18, illustration of the reflection part 13A is omitted. As illustrated in FIG. 18, the load applying part 19 includes a contact part 41 arranged opposite to a back surface of the panel 10, a shaft 42 connected with a lower surface of the contact part 41, and a drive unit 43 that drives the shaft 42 in the up-and-down direction (Z-axis direction). An opening 40 is formed in a center part of the support part 12 and the contact part 41 and the shaft 42 are inserted through this opening 40.

The contact part 41 is made of, for example, resin (for example, silicon resin), rubber, etc. and the shaft 42 is moved upward (positive direction of Z-axis) by the drive unit 43 and the contact part 41 is moved upward to push the back surface of the panel 10. A pressing force against the panel 10 applied by the load applying part 19 is set so as to apply, to the panel 10, a load for suppressing generation of a standing wave in the panel 10.

The load applying part 19 may have a configuration for pushing the surface of the panel 10, and it is sufficient that the load applying part 19 has a configuration to be able to apply, to the panel 10, a load for suppressing generation of a standing wave in the panel 10, not limited to the configuration illustrated in FIG. 18.

This load applying part 19 is controlled by the drive unit 3C illustrated in FIG. 17. As illustrated in FIG. 17, the drive unit 3C includes an acquisition unit 21C, the carrier-wave generating unit 22, the modulation unit 23, the amplifiers 24, and a directivity switching unit 25.

Similarly to the drive unit 3, the drive unit 3C includes (i) a computer including, for example, a CPU, a ROM, a RAM, an HDD, an input/output port, etc. and (ii) various circuits. The CPU reads and executes various programs stored in the ROM so as to realize a function of the acquisition unit 21C, for example. At least a part or a whole of the acquisition unit 21C may be constituted of hardware such as an ASIC and an FPGA. The directivity switching unit 25 may be constituted of an amplification circuit or the like, such as a power amplifier that outputs a driving signal to the drive unit 43.

The acquisition unit 21C is able to acquire a directivity instruction from the external device 60 in addition to the sound signal Ss, when acquiring the directivity instruction, the acquisition unit 21C sends this directivity instruction to the directivity switching unit 25. The directivity instruction includes information for specifying a type of the directivity, and the type of the directivity includes a narrow directivity and a wide directivity, for example.

When a directivity instruction sent from the acquisition unit 21C includes information for specifying a wide directivity, the directivity switching unit 25 drives the load applying part 19 and causes the load applying part 19 to apply a load to the panel 10 so as to suppress generation of a standing wave in the panel 10. Thus, it is possible to change the directivity of the speaker apparatus 10 from a narrow directivity to a wide directivity while continuing output, from the drive unit 3C to the vibration elements 11, of a driving signal according to the modulation signal Sm.

When a directivity instruction sent from the acquisition unit 21C includes information for specifying a narrow directivity, or when a directivity instruction is not output from the external device 60, the directivity switching unit 25 does not drive the load applying part 19. Thus, the speaker apparatus 1C functions as the above speaker of the narrow directivity. In the above example, the reflection part 13A is provided to the sound outputting unit 2C, the speaker apparatus 10 may be configured not to include the reflection part 13A.

Similarly to the speaker system 100 according to the first embodiment, the speaker system may be separately provided with (i) the speaker including the sound outputting unit 2A (or the sound outputting unit 2 or 2B) and (ii) the driving apparatus including the drive unit 3C. In this case, the sound outputting unit 2A may be also configured not to include the reflection part 13A.

Figure 19:
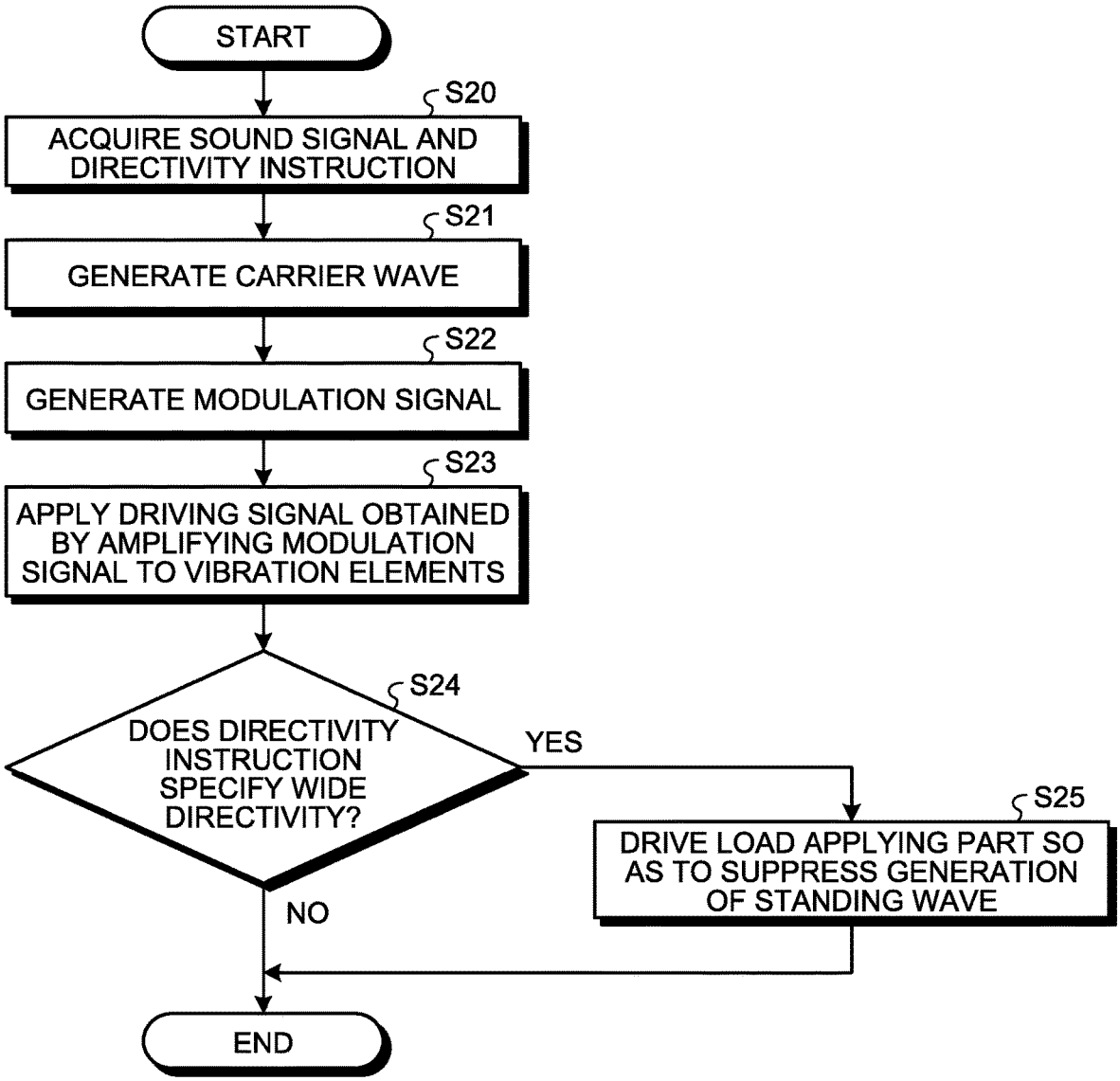
FIG. 19 is a flowchart illustrating one example of a processing procedure to be executed by a drive unit according to the fourth embodiment.

FIG. 19 is a flowchart illustrating one example of a processing procedure to be executed by the drive unit 3C, and the procedure is repeatedly executed. As illustrated in FIG. 19, the drive unit 3C acquires the sound signal Ss and a directivity instruction from the external device 60 (Step S20).

The drive unit 3C generates the carrier wave Sc (Step S21). The drive unit 3C modulates the carrier wave Sc generated in Step S21 by the sound signal Ss acquired in Step S20 so as to generate the modulation signal Sm (Step S22), and applies a driving signal obtained by amplifying the modulation signal Sm to the vibration elements 11 (Step S23).

Next, the drive unit 3C determines whether or not the directivity instruction specifies a wide directivity (Step S24). When the directivity instruction specifies a wide directivity (Step S24: Yes), the drive unit 3C drives the load applying part 19 and causes the load applying part 19 to apply a load to the panel 10 so as to suppress generation of a standing wave in the panel 10 (Step S25).

When the process of Step S25 is terminated, or when the directivity instruction does not specify a wide directivity (Step S24: No), the drive unit 3C repeatedly executes the above processes from the process of Step S20.

As described above, the speaker apparatus 1C according to the fourth embodiment includes the panel 10, the one or more vibration elements 11 that vibrate the panel 10, the drive unit 3C, and the load applying part 19 that applies a load to the panel 10. Similarly to the drive unit 3, the drive unit 3C applies a driving signal to the one or more vibration elements 11 to form the striped vibration region As on the panel 10. The driving signal is obtained by modulating the carrier wave Sc of an ultrasonic band by the sound signal Ss of an audible frequency band. Moreover, the drive unit 3C controls the load applying part 19 to suppress generation of the striped vibration region As on the panel 10. Thus, the directivity of the speaker apparatuses 1, 1A to 1C, is able to be switched between a narrow directivity and a wide directivity by using the panel 10 and the one or more vibration elements 11 that are similar to those of the speaker apparatuses 1, 1A to 1C. Therefore, it is possible to make the speaker apparatuses 1, 1A to 1C, thinner and reduce the cost while changing and adjusting the directivity compared with a case where a vibration part for outputting a sound wave having a wide directivity is additionally provided.

The load applying part 19 includes (i) the contact part 41 that is arranged opposite to the panel 10 and (ii) the drive unit 43 that moves the contact part 41 so as to cause the contact part 41 to contact with the panel 10. Thus, it is possible to suppress generation of the striped vibration region As by a simple configuration.

5. Fifth Embodiment

A speaker apparatus according to a fifth embodiment is different from the speaker apparatus 1C according to the fourth embodiment in that the speaker apparatus according to the fifth embodiment has a function for switching between a narrow directivity and a wide directivity without provided with the load applying part 19. Note that in the following, explanation of configuration elements having functions similar to those of the configuration elements according to the fourth embodiment is omitted by representing with the same reference symbols, and a part different from the speaker apparatus 1C according to the fourth embodiment will be mainly described.

Figure 20:
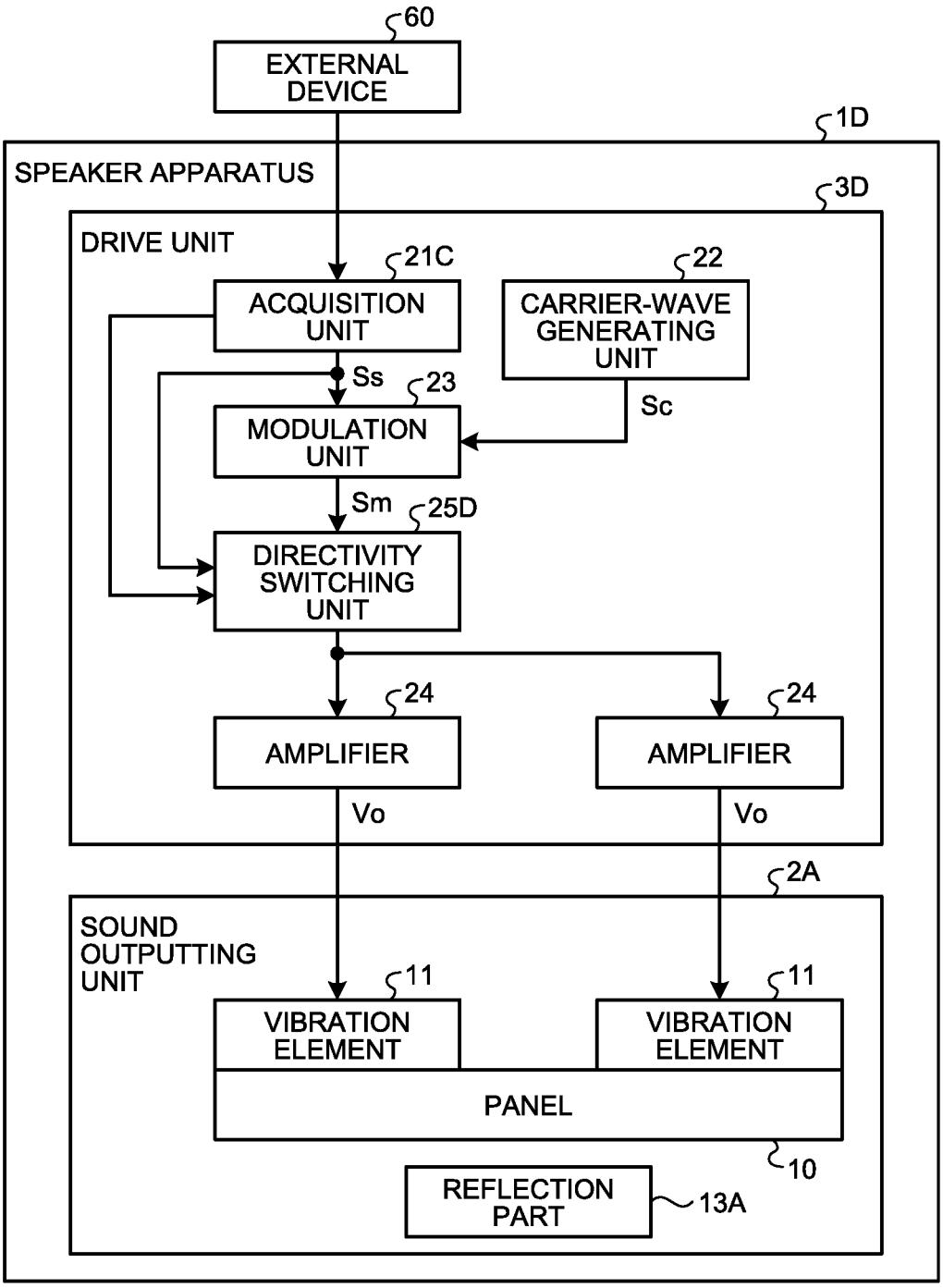
FIG. 20 is a block diagram illustrating a speaker apparatus according to a fifth embodiment.

FIG. 20 is a block diagram illustrating a speaker according to the fifth embodiment. As illustrated in FIG. 20, a speaker apparatus 1D according to the fifth embodiment includes the sound outputting unit 2A and a drive unit 3D. The speaker apparatus 1D may have a configuration including any one of the sound outputting units 2, 2B, 2C instead of the sound outputting unit 2A.

As illustrated in FIG. 20, the drive unit 3D includes the acquisition unit 21C, the carrier-wave generating unit 22, the modulation unit 23, the amplifiers 24, and a directivity switching unit 25D.

Similarly to the drive unit 3C, the drive unit 3D includes (i) a computer including, for example, a CPU, a ROM, a RAM, an HDD, an input/output port, etc. and (ii) various circuits. The CPU reads and executes various programs stored in the ROM so as to realize functions of the acquisition unit 21C, the carrier-wave generating unit 22, the modulation unit 23, and the directivity switching unit 25D. A part or all of the acquisition unit 21C, the carrier-wave generating unit 22, the modulation unit 23, and the directivity switching unit 25D may be constituted of hardware such as an ASIC and an FPGA.

When a directivity instruction sent from the acquisition unit 21C does not include information for specifying a wide directivity, the directivity switching unit 25D outputs, to the amplifiers 24, the modulation signal Sm that is output from the modulation unit 23. Thus, the modulation signal Sm is amplified by the amplifiers 24, and the vibration elements 11 are vibrated at the driving signal Vo (hereinafter, may be referred to as "first driving signal Vo1") according to the modulation signal Sm.

When a directivity instruction sent from the acquisition unit 21C includes information for specifying a wide directivity, the directivity switching unit 25D outputs, to the amplifiers 24, the sound signal Ss that is output from the acquisition unit 21C, instead of the modulation signal Sm that is output from the modulation unit 23. Thus, the sound signal Ss is amplified by the amplifiers 24, and the vibration elements 11 are vibrated at the driving signal Vo (hereinafter, may be referred to as "second driving signal Vo2") according to the sound signal Ss. A sound wave having a frequency of the sound signal Ss is output from the panel 10, and the directivity of the sound wave that is output from the speaker apparatus 1D is able to be changed into a wide directivity.

Figure 21:
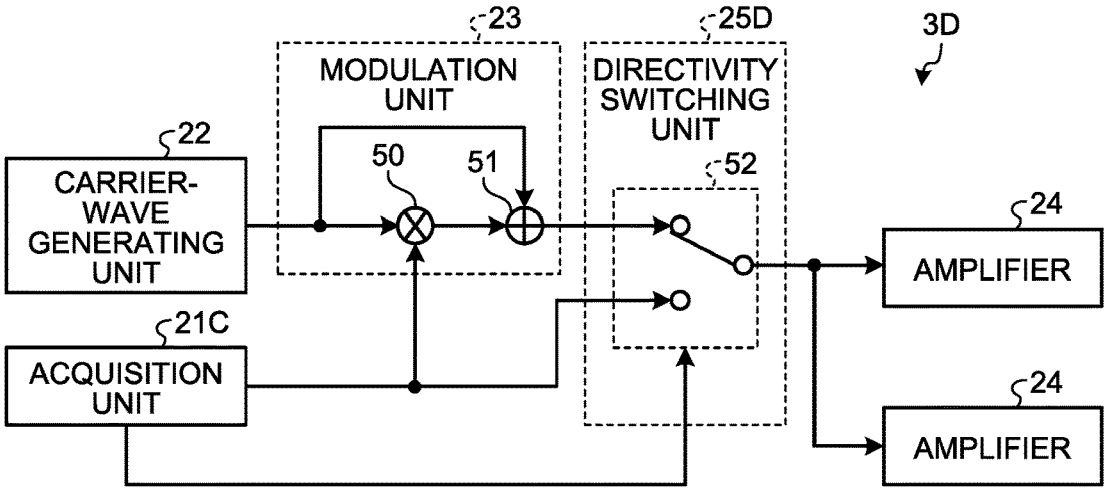
FIG. 21 is a diagram illustrating a configuration example of a directivity switching unit according to the fifth embodiment.

FIG. 21 is a diagram illustrating a configuration example of the directivity switching unit 25D. In the example illustrated in FIG. 21, the modulation unit 23 includes a multiplication unit 50 and an addition unit 51, and the directivity switching unit 25D includes a switch 52. The multiplication unit 50 modulates the carrier wave Sc by the sound signal Ss and the carrier wave Sc is added to the modulated signal so as to generate a modulation signal. The configuration of the modulation unit 23 illustrated in FIG. 21 is merely one example, the configuration of the modulation unit 23 is not limited to the one illustrated in FIG. 21 as long as the modulation unit 23 has a configuration for modulating the carrier wave Sc by the sound signal Ss to generate the modulation signal Sm.

The modulation signal Sm and the sound signal Ss are input to the switch 52. The switch 52 selectively outputs one of the modulation signal Sm and the sound signal Ss on the basis of a directivity instruction sent from the acquisition unit 21C. For example, when a directivity instruction specifies a narrow directivity, the switch 52 outputs the modulation signal Sm acquired from the modulation unit 23 to the amplifiers 24. When the acquisition unit 21C does not acquire a directivity instruction, the switch 52 is also able to output a modulation signal acquired from the modulation unit 23 to the amplifiers 24.

Thus, the first driving signal Vo1 is output to the sound outputting unit 2A and the speaker apparatus 1D functions as a speaker apparatus of a narrow directivity. When a directivity instruction specifies a wide directivity, the switch 52 outputs the sound signal Ss acquired from the acquisition unit 21C to the amplifiers 24. Thus, the second driving signal Vo1 is output to the sound outputting unit 2A and the speaker apparatus 11) functions as a speaker apparatus of a wide directivity. In the above example, the reflection part 13A is provided with the sound outputting unit 2A, the speaker apparatus 1D may have a configuration without the reflection part 13A.

Similarly to the speaker system 100 according to the first embodiment, a speaker system may be employed in which the speaker including the sound outputting unit 2A (or the sound outputting unit 2 or 2B) and a driving device including the drive unit 3D are separately arranged. In this case, the sound outputting unit 2A also may have a configuration without the reflection part 13A.

Figure 22:
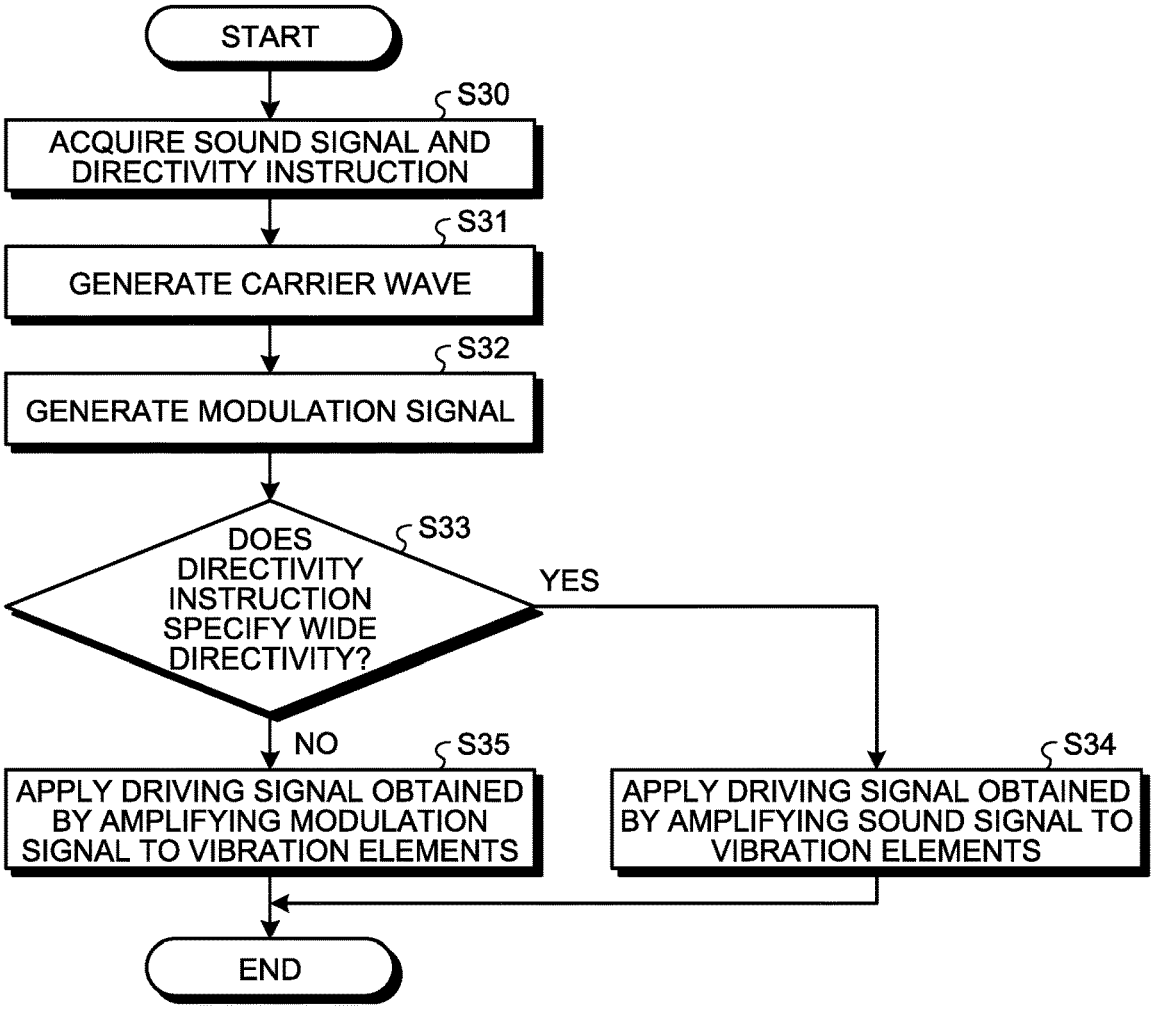
FIG. 22 is a flowchart illustrating one example of a processing procedure to be executed by a drive unit according to the fifth embodiment.

FIG. 22 is a flowchart illustrating one example of a processing procedure to be executed by the drive unit 3D, and the procedure is repeatedly executed. Processes in Steps S30 to S32 are similar to those of Steps S20 to S22, and thus explanation thereof is omitted.

As illustrated in FIG. 22, the drive unit 3D determines whether or not a directivity instruction specifies a wide directivity (Step S33). When determining that the directivity instruction specifies a wide directivity (Step S33: Yes), the drive unit 3D applies, to the vibration elements 11, the driving signal Vo1 obtained by amplifying the sound signal Ss acquired in Step S30 (Step S34). On the other hand, when determining that the directivity instruction does not specify a wide directivity (Step S33: No), the drive unit 3D applies, to the vibration elements 11, the driving signal Vo1 obtained by amplifying the modulation signal Sm (Step S35).

As described above, the speaker apparatus 1D according to the fifth embodiment includes the panel 10, the one or more vibration elements 11 that vibrates the panel 10, and the drive unit 3D. The drive unit 3D applies a first driving signal to the one or more vibration elements 11 to form the striped vibration region As on the panel 10. The first driving signal is generated by modulating the carrier wave Sc of an ultrasonic band by the sound signal Ss of an audible frequency band. The drive unit 3D switches between the first driving signal Vo1 and the second driving signal Vo2 that is generated by the sound signal Ss, and applies the switched signal to the one or more vibration elements 11. Thus, it is possible to switch the directivity of the speaker apparatus 1D between a narrow directivity and a wide directivity by using the panel 10 and the one or more vibration elements 11 that are similar to those of the speaker apparatuses 1, 1A to 1C without additionally adding a member to the sound outputting units 2, 2A, 2B. Therefore, it is possible to make the speaker apparatus 1D thinner and reduce the cost while changing and adjusting the directivity, compared with a case in which a vibration part for outputting a sound wave of a wide directivity is additionally provided.

The drive unit 3D includes (i) the carrier-wave generating unit 22 that generates the carrier wave Sc, (ii) the modulation unit 23 that generates the modulation signal Sm obtained by modulating the carrier wave Sc, which is generated by the carrier-wave generating unit 22, by the sound signal Ss, and (iii) the directivity switching unit 25D (one example of switching unit) that switches between the modulation signal Sm output from the modulation unit 23 and the sound signal Ss, and outputs the switched signal. Thus, the directivity of the speaker apparatus 1D is able to be switched between a narrow directivity and a wide directivity only by providing the directivity switching unit 25D, so that it is possible to reduce the cost, for example.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A speaker apparatus comprising:

a panel;

one or more vibration elements that vibrate the panel;

a drive unit that applies a driving signal to the one or more vibration elements to form a striped vibration region on the panel, the driving signal being obtained by modulating a carrier wave of an ultrasonic band by a sound signal of an audible frequency band, the striped vibration region including a plurality of line-shaped vibration regions that are antinodes of a standing wave generated on the panel, a group of first ultrasonic waves and a group of second ultrasonic waves being generated by interference between a plurality of ultrasonic waves generated from the plurality of line-shaped regions, the group of first ultrasonic waves respectively radiating from the plurality of line-shaped vibration regions in a first direction, and the group of second ultrasonic waves respectively radiating from the plurality of line-shaped vibration regions in a second direction that is different from the first direction; and a reflection part that reflects the group of second ultrasonic waves to cause the group of second ultrasonic waves to advance in the first direction.

2. The speaker apparatus according to claim 1, wherein the reflection part is arranged close to an end part of the panel, and includes a reflection plate extending in a direction intersecting with the panel.

3. The speaker apparatus according to claim 1, further comprising a load applying part that applies a load to the panel, wherein the drive unit controls the load applying part to suppress generation of the vibration region.

* * * * *